US010477958B2

(12) United States Patent
Xi et al.

(10) Patent No.: US 10,477,958 B2
(45) Date of Patent: Nov. 19, 2019

(54) MULTI-COMPONENT BRISTLE HAVING COMPONENTS WITH DIFFERENT ORAL CARE ADDITIVES, AND ORAL CARE IMPLEMENT COMPRISING THE SAME

(71) Applicant: COLGATE-PALMOLIVE COMPANY, New York, NY (US)

(72) Inventors: Wen Jin Xi, Shanghai (CN); Ting Yan, Shanghai (CN); Bo Zhang, Yangzhou (CN); Guang Sheng Guo, Yangzhou (CN)

(73) Assignee: Colgate-Palmolive Company, New York, NY (US)

( * ) Notice: Subject to any disclaimer, the term of this patent is extended or adjusted under 35 U.S.C. 154(b) by 288 days.

(21) Appl. No.: 15/595,640

(22) Filed: May 15, 2017

(65) Prior Publication Data

US 2017/0245628 A1 Aug. 31, 2017

Related U.S. Application Data

(63) Continuation-in-part of application No. 15/102,817, filed as application No. PCT/CN2013/089206 on
(Continued)

(51) Int. Cl.
*A46B 9/06* (2006.01)
*A46D 1/00* (2006.01)
(Continued)

(52) U.S. Cl.
CPC ..... *A46D 1/006* (2013.01); *A46D 1/023* (2013.01); *A46D 1/0276* (2013.01);
(Continued)

(58) Field of Classification Search
CPC ..... A46D 1/006; A46D 1/023; A46D 1/0276; A46B 2200/1066; D01F 1/10; D01F 6/60; D01F 6/62
See application file for complete search history.

(56) References Cited

U.S. PATENT DOCUMENTS 5,533,227 A 7/1996 Ito et al.
5,985,192 A 11/1999 Weihrauch
(Continued)

FOREIGN PATENT DOCUMENTS

CN 1582865 2/2005
CN 201019215 2/2008
(Continued)

OTHER PUBLICATIONS

International Search Report and the Written Opinion of the International Searching Authority issued in International Patent Application PCT/CN2013/089172 dated Sep. 10, 2014.
(Continued)

*Primary Examiner* — Shay Karls

(57) ABSTRACT

An oral care implement including at least one multi-component bristle. In one aspect, the invention can be an oral care implement having a handle; a head coupled to the handle; at least one bristle tuft extending from the head, the at least one bristle tuft comprising at least one multi-component bristle comprising first and second components. The first component may include a first plastic and a first oral care additive and the second component may include a second plastic and a second oral care additive such that the first oral care additive is different than the second oral care additive.

20 Claims, 19 Drawing Sheets

Related U.S. Application Data

Dec. 12, 2013, now Pat. No. 10,299,580, application No. 15/595,640, which is a continuation-in-part of application No. 15/102,754, filed as application No. PCT/CN2013/089172 on Dec. 12, 2013, now Pat. No. 9,681,743.

(51) Int. Cl.

| | |
|---|---|
| *D01F 1/10* | (2006.01) |
| *D01F 6/60* | (2006.01) |
| *D01F 6/62* | (2006.01) |
| *D01F 8/12* | (2006.01) |
| *D01F 8/14* | (2006.01) |

(52) U.S. Cl.

CPC ..... *A46B 2200/1066* (2013.01); *D01F 1/10* (2013.01); *D01F 6/60* (2013.01); *D01F 6/62* (2013.01); *D01F 8/12* (2013.01); *D01F 8/14* (2013.01)

(56) References Cited

U.S. PATENT DOCUMENTS

| | | | |
|---|---|---|---|
| D423,787 | S | 5/2000 | Musciano |
| 6,058,541 | A | 5/2000 | Masterman et al. |
| 6,079,087 | A | 6/2000 | Cansler |
| 6,141,819 | A | 11/2000 | Driesen et al. |
| 6,161,243 | A | 12/2000 | Weihrauch |
| 6,280,113 | B1 | 8/2001 | Gueret |
| 6,390,708 | B1 | 5/2002 | Gueret |
| 6,823,552 | B1 | 11/2004 | Hillenbrand |
| D501,999 | S | 2/2005 | Hellmann |
| 6,871,373 | B2 | 3/2005 | Driesen et al. |
| 7,134,162 | B2 | 11/2006 | Kweon et al. |
| D610,810 | S | 3/2010 | Evans |
| D627,972 | S | 11/2010 | Evans |
| D627,973 | S | 11/2010 | Evans |
| D628,806 | S | 12/2010 | Van der Lande |
| D634,934 | S | 3/2011 | Kalbfeld et al. |
| 8,029,069 | B2 | 10/2011 | Kwon et al. |
| 8,099,821 | B2 | 1/2012 | Herzog et al. |
| 8,297,710 | B2 | 10/2012 | Sakurai et al. |
| 8,632,268 | B2 | 1/2014 | Kemp |
| 2009/0094770 | A1 | 4/2009 | Zoschke et al. |
| 2011/0138559 | A1 | 6/2011 | Plotka et al. |
| 2011/0232014 | A1 | 9/2011 | Uchida et al. |
| 2011/0308026 | A1 | 12/2011 | Jimenez et al. |
| 2012/0174331 | A1 | 7/2012 | Kwon et al. |
| 2012/0301210 | A1 | 11/2012 | Sturgis et al. |
| 2015/0257525 | A1* | 9/2015 | Kang ..... A46D 1/0207 15/167.1 |

FOREIGN PATENT DOCUMENTS

| | | | | |
|---|---|---|---|---|
| GB | 2323026 | B * | 5/2001 | ..... A46B 15/001 |
| JP | H02283312 | | 11/1990 | |
| JP | H0387322 | | 9/1991 | |
| JP | H03289906 | | 12/1991 | |
| JP | 2003144231 | | 5/2003 | |
| JP | 2005000310 | A * | 1/2005 | |
| JP | 2010125046 | | 6/2010 | |
| WO | WO 2007/104381 | | 9/2007 | |

OTHER PUBLICATIONS

International Search Report and the Written Opinion issued in International Patent Application PCT/CN2013/089206 dated Sep. 19, 2014.

Yangzhou Jimxia Plastic Products & Rubber Col, Ltd., http://cnixsi.en.alibaba.com/product/620430647-_200912796/Anti_bacterial_filaments_Tapered_Spiral_filaments_Latest_toothbrush.html, downloaded from the Internet prior to the date of the application.

* cited by examiner

MULTI-COMPONENT BRISTLE HAVING COMPONENTS WITH DIFFERENT ORAL CARE ADDITIVES, AND ORAL CARE IMPLEMENT COMPRISING THE SAME

CROSS-REFERENCE TO RELATED APPLICATIONS

The present application is a continuation-in-part of U.S. patent application Ser. No. 15/102,754, filed Jun. 8, 2016, which is a U.S. national stage application under 35 U.S.C. § 371 of PCT/CN2013/089172, filed Dec. 12, 2013. The present application is also a continuation-in-part of U.S. patent application Ser. No. 15/102,817, filed Jun. 8, 2016, which is a U.S. national stage application under 35 U.S.C. § 371 of PCT/CN2013/089206, filed Dec. 12, 2013, the entireties of which are incorporated herein by reference.

BACKGROUND

Toothbrushes are typically used by applying toothpaste or dentifrice to a bristle section on the head of the toothbrush, followed by brushing regions of the oral cavity (e.g., the teeth or soft tissue such as the tongue and/or gums) with the bristle section. Some toothbrushes have been equipped with internal reservoirs and systems for delivering dentifrice to a user's oral cavity. Other toothbrushes have been developed that include dentifrice that is pre-coated onto the bristles. However, in known toothbrushes only dentifrice or a single oral care additive is available for application to a user's oral cavity. Thus, a need exists for a toothbrush having multiple different oral care additives for application to a user's oral cavity.

BRIEF SUMMARY

Exemplary embodiments according to the present disclosure are directed to oral care implements that have at least one multi-component bristle extending from the head thereof. The multi-component bristle is formed by first and second components. In one embodiment, each of the first and second components comprises a different oral care additive.

In one aspect, the invention can be an oral care implement comprising a handle; a head coupled to the handle; at least one bristle tuft extending from the head, the at least one bristle tuft comprising at least one multi-component bristle comprising a first component and a second component; the first component comprising a first plastic and a first oral care additive; the second component comprising a second plastic and a second oral care additive, wherein the first oral care additive is different than the second oral care additive.

In another aspect, the invention can be a multi-component bristle comprising: a first component; a second component; the first component comprising a first plastic and a first oral care additive; and the second component comprising a second plastic and a second oral care additive, wherein the first oral care additive is different than the second oral care additive.

In yet another aspect, the invention can be an oral care implement comprising: a handle; a head coupled to the handle; at least one bristle tuft extending from the head, the at least one bristle tuft comprising at least one multi-component bristle comprising a first component and a second component; the first component comprising a first oral care additive; and the second component comprising a second oral care additive, wherein the first oral care additive is different than the second oral care additive.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
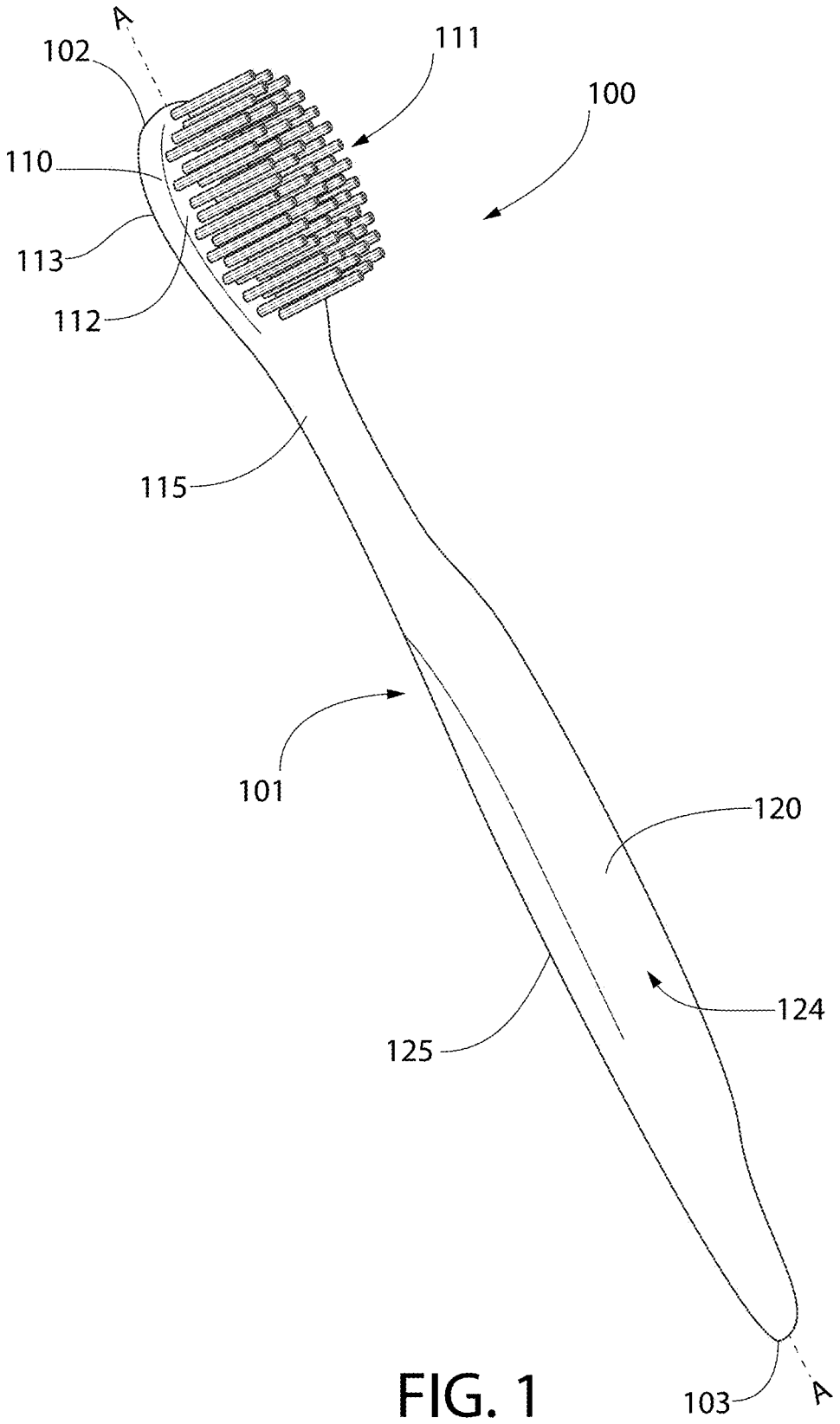
FIG. 1 is a front perspective view of an oral care implement having spiral bristles according to an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 103 to a distal end 102 along a longitudinal axis A-A. The oral care implement 100 generally includes an elongated body 101 comprising a head 110, a neck 115 and a handle 120. The handle 120 is an elongated structure that provides the mechanism by which the user can hold and manipulate the oral care implement 100 during use. The handle 120 comprises a front surface 124 and an opposing rear surface 125. In the exemplified embodiment, the handle 120 is generically depicted having various contours for user comfort. More specifically, in the exemplified embodiment the handle 120 is bulbous shaped and has a larger diameter in a central region than near the proximal end 103 and neck 115. Specifically, a region of the handle 120 that would normally be gripped by a user's thumb has a width that is greater than a width of the neck 115. Of course, the invention is not to be so limited in all embodiments and in certain other embodiments the handle 120 can take on a wide variety of shapes, contours and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user.

The head 110 of the oral care implement 100 is coupled to the handle 120 and comprises a front surface 112 and an opposing rear surface 113. In the exemplified embodiment, the head 110 is formed integrally with the handle 120 as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners.

In the exemplified embodiment, the head 110 of the oral care implement 100 is provided with a plurality of tooth cleaning elements 111 extending from the front surface 112. Although in the exemplified embodiment all of the tooth cleaning elements 111 appear to be the same, the invention is not to be so limited in all embodiments. For example, in certain embodiments the tooth cleaning elements 111 include at least one bristle tuft comprising at least one spiral bristle. A single spiral bristle is formed by intertwining two or more strand components or strands together, which will be described in more detail below with reference to FIGS. 2-6. A bristle tuft is a collection of bristles that are positioned together into a single tuft hole formed on the head 110. Each bristle tuft may include, for example without limitation, only spiral bristles, a combination of spiral bristles and non-spiral bristles, or only non-spiral bristles. In certain embodiments, the oral care implement 100 may include one or more bristle tufts that include exactly one spiral bristle and other non-spiral bristles or one or more bristle tufts that include only spiral bristles. In still other embodiments, the tooth cleaning elements 111 may all be formed as bristle tufts that are formed solely of spiral bristles. Furthermore, in some embodiments the tooth cleaning elements 111 may include some bristle tufts that are formed solely of non-spiral bristles and some bristle tufts that are formed solely of spiral bristles, and the non-spiral bristle tufts and spiral bristle tufts may be positioned on the head 110 of the oral care implement 100 in an alternating or non-alternating fashion (i.e., alternating or non-alternating transverse rows of bristle tufts).

Other than including at least one bristle tuft comprising at least one spiral bristle, the exact structure, pattern, orientation and material of the remainder of the tooth cleaning elements 111 is not to be limiting of the present invention unless so specified in the claims. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 111 of the present invention can be connected to the head 110 in any manner known in the art. For example, staples/anchors, in-mold tufting (IMT) or anchor free tufting (AFT) could be used to mount the cleaning elements/tooth engaging elements. In certain embodiments, the invention can be practiced with various combinations of stapled, IMT or AFT bristles. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In the exemplified embodiment, the head 110 of the oral care implement 100 comprises a plurality of tuft holes (not visible) formed therein. A plurality of tufts of bristles are positioned within and affixed to the head 110 within each of the tuft holes. Each of the tufts of bristles includes a plurality of bristles, which can be single strand bristles, double strand spiral bristles, triple strand spiral bristles, etc. or various combinations thereof. Thus, one tuft of bristles may include one double strand spiral bristle and a plurality of single strand bristles or only double strand spiral bristles or only triple strand spiral bristles or a combination of single strand bristles, double strand spiral bristles and triple strand spiral bristles. Additionally, a single tuft hole may be filled with an elastomeric cleaning element or any of the other types of cleaning elements noted above. As noted above, in one embodiment at least one bristle tuft includes at least one spiral bristle, which may be a double, triple or otherwise strand spiral bristle. The details of the spiral bristles will be discussed in more detail below with reference to FIGS. 2-6.

Although not illustrated herein, in certain embodiments the head 110 may also include a soft tissue cleanser coupled to or positioned on its rear surface 113. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Figure 2:
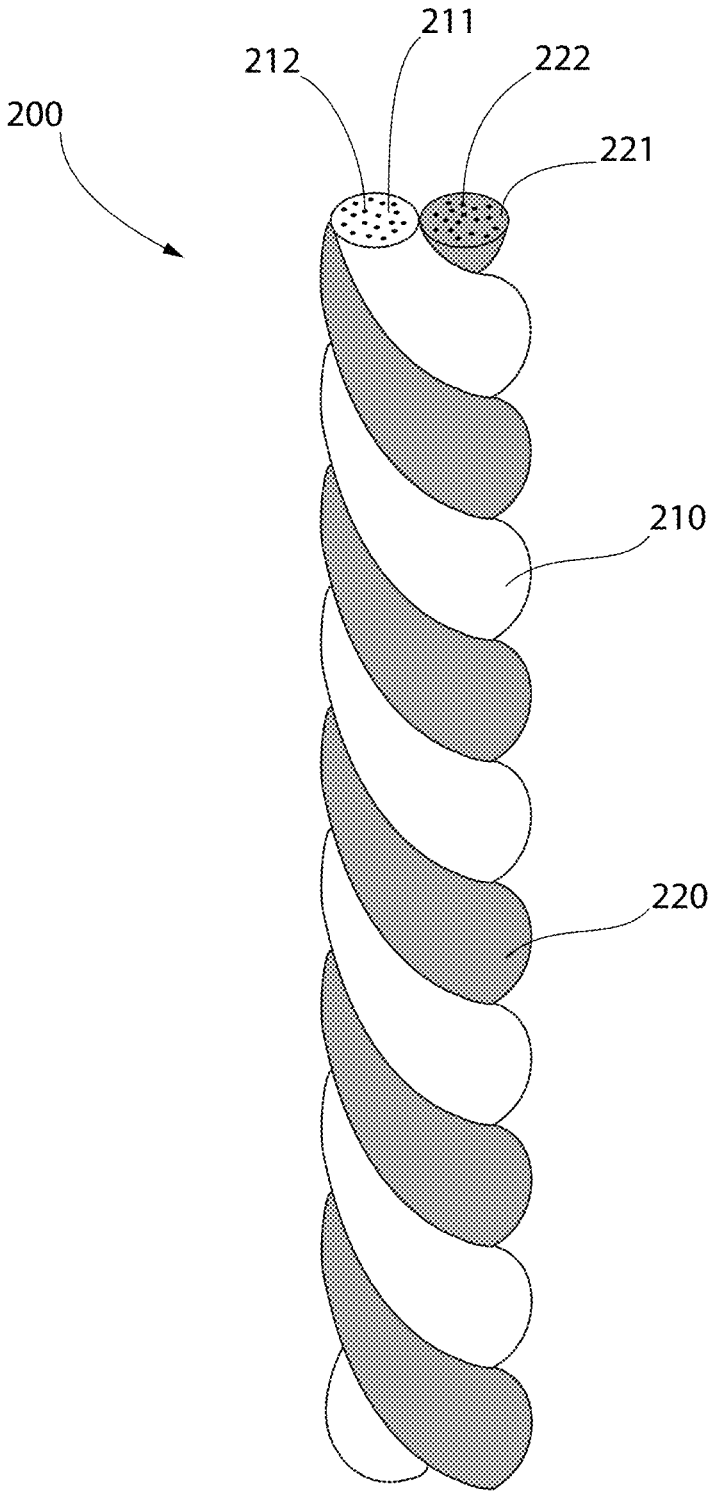
FIG. 2 is a front perspective view of a multi-component bristle in accordance with a first embodiment of the present invention.

Referring now to FIG. 2, a spiral bristle 200 is illustrated in accordance with an embodiment of the present invention. The spiral bristle 200 comprises a first strand component 210 and a second strand component 220 that are intertwined together to form the spiral bristle 200. In the exemplified embodiment, the first and second strand components 210, 220 wind around one another five times apiece. However, the invention is not to be so limited and more or less spirals/windings can be used to form the spiral bristle 200.

In the exemplified embodiment, the first and second strand components 210, 220 are cylindrical shaped strands, although the invention is not to be so limited and the first and second strand components 210, 220 can be any polygonal shape as will be discussed in more detail below with reference to FIGS. 3 and 4. Furthermore, in certain embodiments one of the first and second strand components 210, 220 may have grooves, ridges, pockets or recessed areas within which the other strand component is disposed when the first and second strand components 210, 220 are intertwined together, as discussed in more detail below with reference to FIG. 7. In certain embodiments, the first and second strand components 210, 220 can be coextruded to form the spiral bristle 200. In such an embodiment, the spiral bristle 200 may be considered to be a monofilament. In other embodiments, the first and second strand components 210, 220 can be extruded separately from one another and then later twisted together to form the spiral bristle 200. The exact manner of forming the spiral bristle 200 is not to be limiting of the present invention unless so specified in the claims.

Due to the nature of spiral bristle formation in that two or more strand components are intertwined together to form the spiral bristle, these strand components can be used to house, store or otherwise contain oral care additives including oral care agents. Each of the strand components that is used to form the spiral bristle can house the same oral care additive, a different oral care additive, or only one of the two or more strand components that forms a single spiral bristle can contain an oral care additive while the other of the two or more strand components may be devoid of an oral care additive. Thus, in certain embodiments two or more oral care additives can be housed separately on different strand components of a single spiral bristle and can be made to intermix during use of the spiral bristle (or oral care implement on which the spiral bristle is disposed). Intermixing of two or more oral care additives can be beneficial so that a chemical reaction occurs within a user's oral cavity and so that in some circumstances a third oral care additive or agent can be formed by the reaction of the first and second oral care additives within the user's oral cavity.

Referring still to FIG. 2, in certain embodiments the first strand component 210 comprises a first plastic 211 and a first oral care additive 212 and the second strand component 220 comprises a second plastic 221 and a second oral care additive 222, the second oral care additive 222 being different than the first oral care additive 221. In the exemplified embodiment, the first strand component 210 is illustrated as a lighter color than the second strand component 220 to schematically illustrate that each of the first and second strand components 210, 220 contains a different oral care additive. Although described herein as the first and second strand components 210, 220 having different oral care additives, in certain embodiments each of the first and second strand components 210, 220 may have the same oral care additive, or one of the first and second strand components 210, 220 may be devoid of an oral care additive while the other of the first and second strand components has an oral care additive.

In certain embodiments, forming the first strand component 210 is achieved by melting the first plastic 211 and dispersing particles of the first oral care additive 212 within the melted first plastic 211. The particles of the first oral care additive 212 are thereby mixed into the first plastic 211 so that the first strand component 210, when formed, will contain the first oral care additive 212. Similarly, forming the second strand component 220 is achieved by melting the second plastic 221 and dispersing particles of the second oral care additive 222 within the melted second plastic 221. The particles of the second oral care additive 222 are thereby mixed into the second plastic 221 so that the second strand component 220, when formed, will contain the second oral care additive 222. As noted above, the first and second oral care additives 212, 222 can be the same or different.

Upon cooling, the first and second melted plastics 211, 221 will become hardened and the first and second oral care additives 212, 222 will be housed, contained or dispersed within the respective first and second plastics 211, 221. Next, in certain embodiments the first and second plastics 211, 221 can be coextruded to form the spiral bristle 200 from the first and second strand components 210, 220. Alternatively, the first plastic 211 with the first oral care additive 212 therein can be formed into the first strand component 210 and the second plastic 221 with the second oral care additive 222 therein can be separately formed into the second strand component 220 (either by separate extrusion processes or any other bristle strand forming process now known or later developed), and then the first and second strand components 210, 220 can be twisted together to form the spiral bristle 200. In either case, the spiral bristle 200 is formed from the first and second strand components 210, 220, each of which contains a different (or the same) oral care additive or agent therein. Of course, as noted above one of the two strand components 210, 220 may be formed without dispersing an oral care additive therein if desired.

In other embodiments, the oral care additives need not be applied to the melted plastics in particle form. Rather, in other embodiments the oral care additives can be added to the respective strand components by forming the strand components with a tactile or sticky texture to hold the oral care additives thereon, or by forming the strand components with grooves, ledges, holes, hollows or other features and/or surface structure, shape or configuration that facilitates the housing of a powder, liquid, gel, paste or other form of oral care additive. Regardless of the manner of forming the spiral bristles with oral care additives therein, the oral care additives 212, 222 are releasable from the first and second plastics 211, 222 and from the first and second strand components 210, 220 of the spiral bristle 200, particularly during use of the oral care implement 100 as will be described in more detail below, in order to provide oral health benefits to a user.

Furthermore, in certain embodiments the oral care additives, in any form (i.e., particle, powder, liquid, gel, paste etc.), may be embedded or housed within or otherwise carried by one or more carriers which are then formed into, housed or contained within the first and second strand components 210, 220. Specifically, the first oral care additive 212 may be carried by a first carrier and the second oral care additive 222 may be carried by a second carrier. In one embodiment, each of the first and second carriers may be one or more water-soluble polymers. In such an embodiment, the oral care additives 212, 222 may be carried by, disposed within or embedded within the one or more water-soluble polymers, and then the water-soluble polymers can be added to the melted plastic that is used to form the first and second strand components 210, 220 as described above. In this manner, the carriers will be mixed or formed into the plastic material that forms the first and second strand components 210, 220, the carriers carrying the oral care additives. In such embodiments, it may be desirable for the first carrier to have a higher melting point than the melting point of the first plastic 211 and for the second carrier to have a higher melting point than the melting point of the second plastic 221 so that the carrier or water-soluble polymer maintains its structure and retains the oral care additive therein when being added to the melted plastic. As the plastic cools and hardens, the carriers may then be contained or dispersed within the plastic as the plastic is formed into the individual strand components.

In certain embodiments, each of the first and second carriers can comprise one or more degradable or dissolvable capsules that carry, contain or encapsulate the first and second oral care additives 212, 222 therein. The capsules may be soluble in liquid, such as saliva, to release the oral care additives 212, 222 contained therein during use of the oral care implement 100. Stated another way, the capsules degrade when subject to moisture and thus dissolve when mixed with the saliva of the user to release its contents. Alternatively, the capsules may have frangible, thin walls that break, rupture or burst to release the oral care additives 212, 222 contained therein during use due to being contacted by or rubbed against the user's teeth. In other embodiments, each of the first and second carriers can comprise one or more matrices that carry the first and second oral care additives 212, 222. Similar to the capsules, the matrices may also dissolve or break to release the oral care additives 212, 222 contained therein during use of the oral care implement 100. In other embodiments, one of the first and second carriers can comprise one or more capsules carrying the first oral care additive and the other of the first and second carriers can comprise one or more matrices carrying the second oral care additive, or each of the first and second carriers may comprise a combination of capsules and matrices that carry the respective oral care additives.

Using the carriers to house the oral care additives may assist in ensuring that the oral care additives are properly retained on the strand components and released into a user's oral cavity during use of the oral care implement 100. Specifically, in embodiments wherein the carriers are water-soluble polymers, such carriers/water-soluble polymers will degrade, shrink or dissolve in the user's saliva during use of the oral care implement, thereby releasing the oral care additives from the carriers and into a user's oral cavity. The solubility of such water-soluble polymers can be selected as desired to create a spiral bristle having immediate release of all of the oral care additives contained therein or a timed release of the oral care additives contained therein.

In certain embodiments the first and/or second carriers may be formed for timed or slow release of the oral care additives contained therein so that the benefits of the oral care additives can be obtained by the user over many uses of the oral care implement 100. In one embodiment, the carriers may degrade over a period of three months so that upon the entire oral care additive having been released into the user's oral cavity during brushing, the user will know that it is time to replace the toothbrush. In certain embodiments, the strand components of the spiral bristle 200 may change color upon the oral care additive contained therein being depleted to visually communicate to a user that toothbrush replacement is needed. Thus, the spiral bristles 200 can serve as both oral care additive containment/dispensing structures and as a wear indicator.

In other embodiments, the first strand component 210 may include first carriers (i.e., water-soluble polymers) that degrade or dissolve within a first temporal period of time and the second strand component 220 may include second carriers (water-soluble polymers) that degrade or dissolve within a second temporal period of time so that the oral care additives within the second carriers do not begin to be released until the entirety of the oral care additives within the first carriers have been released. Thus, the second carriers will not begin to dissolve until the entirety of the first carriers has dissolved, such that the first carriers will have a higher solubility than the second carriers. In other embodiments, the first and/or second carriers may completely erode, degrade, shrink or dissolve during a first use so that the entirety of the oral care additives contained therein is released into the user's oral cavity during a single use. In such embodiments, the oral care implement 100 may be a disposable or single use toothbrush.

The first and second oral care additives 211, 221 can be any of a variety of oral care additives that provide proven benefits to a user's oral health. Such oral care additives include, without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+. The lotus seed is the extract from lotus seeds and is a natural herb for anti-heating and the prevention of gum bleeding. The lotus flower is the extract from the lotus flower and is a natural herb for anti-heating and the prevention of gum bleeding. Bamboo salt is the combination of a bamboo extract and salt and is used to diminish inflammation and has anti-bacterial effects. Jasmine is an extract from the jasmine flower and is a natural herb for anti-heating, preventing gum bleeding and for mouth freshening. Corn mint is an extract from a corn mint leaf and is a natural herb for anti-heating, anti-bacterial uses and mouth freshening. Camellia is an extract from the camellia flower and is a natural herb for anti-heating and the prevention of gum bleeding. Aloe is an extract from the aloe leaf and is a natural herb for inflammation reduction and has anti-bacterial effects. Gingko is an extract from the gingko leaf and is a natural herb for inflammation reduction and has anti-bacterial effects. Tea tree oil is an extract from a tea tree and is a natural herb for diminishing inflammation and has anti-bacterial effects. Xylitol is an extract from plants such as corn, sugar cane, oak, birch, etc. and can be used for preventing tooth decay. Sea salt is an extract from the sea and can be used to reduce inflammation and has anti-bacterial effects. Vitamin C is an extract from food and can be used to prevent gum bleeding and as an antioxidant. Ginger is an extract from ginger and is a natural plant for diminishing inflammation and has anti-bacterial effects. Cactus is an extract from a cactus and it a natural plant for reducing inflammation and can be used as an antioxidant. Backing soda is a chemistry product and can be used as an enamel protectant. Pine tree salt is a mixture of the extract from pine trees and salt and is an ancient Chinese medicine for preventing inflammation and anti-heating. Green tea is an extract from the green tea leaf and is a natural herb to prevent halitosis and inhibit bacteria growth. White pearl is a kind of pearl powder and can be used for teeth whitening and teeth health improvement by calcium absorption. Black pearl is a kind of pearl powder that can be used for teeth whitening, cleaning and stain removal. Charcoal is made from an oak tree by carbonization and it helps to for moisture adjustment and to reduce the growth of bacteria. Nephrite (jade) is a kind of nephrite powder and can be used to prevent gum disease and boost the blood circulation of the gums. Ag/Au is an anti-bacterial additive contained in the Ag/Au ion (i.e., silver/gold) and can be used to inhibit bacterial growth. In certain embodiments, each of the first and second oral care additives are selected from a group consisting of a mixture of pine tree extract and salt, a tea leaf extract, a pearl powder, a nephrite powder, a charcoal powder, and an antibacterial material. In some embodiments, the oral care additives are natural ingredients.

In certain embodiments, each of the first and second strand components 210, 220 may have a different color to provide both a visual aesthetic and to communicate information about the oral care additive contained on that particular strand component to a user. Thus, for example, a spiral bristle may include a first strand component that contains an orange flavored oral care additive and a second strand component that contains a lemon flavored oral care additive. In such an embodiment, the first strand component may be orange in color and the second strand component may be yellow in color to visually communicate their respective flavors to a user. Similarly, a spiral bristle may include a first strand component that has a green tea extract and a second strand component that includes black pearl. In such an embodiment, the first strand component may be green in color and the second strand component may be black in color to visually communicate their respective oral care additives to a user. Similarly, the color blue can be used to inform a user that a particular strand component will provide a cooling trigeminal effect to the user, the color red can be used to inform a user that a particular strand component contains an oral care additive that will boost blood circulation, the color purple can be used to inform a user that a particular strand component contains an anti-inflammatory oral care additive, etc. Color-coding the strand components of the spiral bristles provides a desirable visual aesthetic as well as being informative for the user or consumer. The oral care implement on which the spiral bristles are contained may include a color-coded key on its handle, head, packaging or on a separate instruction/information sheet that is provided with the oral care implement to inform the user of the message that the various colored strand components are intended to convey.

In certain embodiments, any of one or more of the above oral care additives can be included into each of the first and second strand components 210, 220 that are used to form the spiral bristle 200. However, in certain embodiments one of the above oral care additives is included into the first strand component 210 and a second one of the above oral care additives is included into the second strand component 220, the second one of the above oral care additives being different than the first one of the above oral care additives. In certain embodiments, the first and second oral care additives may each have an agent that is selected so that during brushing the agents of the first and second oral care additives mix together to form a third oral care additive or agent. Specifically, prior to brushing the first oral care additive will remain chemically isolated from the second oral care additive despite the first and second oral care additives being on the same spiral bristle 200 because the first oral care additive is formed into or carried by the first strand component 210 and the second oral care additive is formed into or carried by the second strand component 220. During brushing, the first and second strand components 210, 220 will get wet, which enables the first oral care additive 212 (or a portion thereof) to be released from the first strand component 210 and the second oral care additive 222 (or a portion thereof) to be released from the second strand component 220. When the first and second oral care additives 212, 222 are simultaneously released, the agents within those oral care additives may intermix within the user's oral cavity to form a third agent in some embodiments.

Intermixing of the first and second oral care additives within the user's oral cavity can be beneficial in certain instances. Specifically, certain agents, medicaments, anesthetics, antimicrobial agents, polishes, whiteners and other miscellaneous agents, substances and chemicals lose effectiveness over time. Thus, it may be desirable to apply such substances substantially immediately after their formation. Using the strand components 210, 220 of the spiral bristle 200 as the structures on which the oral care additives are housed facilitates this intermixing within the user's oral cavity.

As noted above, the two oral care additives can be selected so that they form a third oral care additive or agent upon intermixing within a user's oral cavity. Some reactions that may be used include: (1) mixing a base with an acid to form a neutral; (2) mixing a base with a curing agent to form an epoxy resin; (3) mixing Bisphenol F with Epichchlorhydin to form diglycidyl ether of bisphenoal A (epoxy resin); (4) mixing calcium carbonate with hydrogen peroxide to form peroxide; (5) mixing water with hydrogen peroxide to form peroxide; (6) mixing potassium nitrate with stannous fluoride to form a sensitivity agent; (7) mixing chlorhexadine with silica to form an antimicrobial agent; (8) mixing cetylpyridinium chloride with silica to form an antimicrobial agent; (9) mixing tricolsan with pyrophosphate to form an antimicrobial agent; and (10) mixing a first flavor with a second flavor to form a third flavor. Thus, various oral care additives/agents can be formed that are known for tooth whitening, cleaning, antimicrobial, antibacterial, taste or other desired effects.

As noted above, the first strand component 210 is formed of the first plastic 211 and the second strand component 220 is formed of the second plastic 221. In certain embodiments, each of the first and second plastics 211, 221 is the same. In such embodiments, both of the first and second plastics 211, 221 may be erodible by an etchant or neither of the first and second plastics 211, 221 may be erodible by the etchant. However, in other embodiments the first and second plastics 211, 221 are different. In one particular embodiment, the first plastic 211 is erodible by an etchant and the second plastic 221 is chemically resistant by the etchant. Furthermore, in one embodiment the first plastic 211 is a polyester, such as polybutylene terephthalate (PBT), and the second plastic 221 is a polyamide, such as nylon. Of course, the invention is not to be limited by the particular materials that are used to form the first and second strand components 210, 220 unless so specified in the claims.

Figure 3:
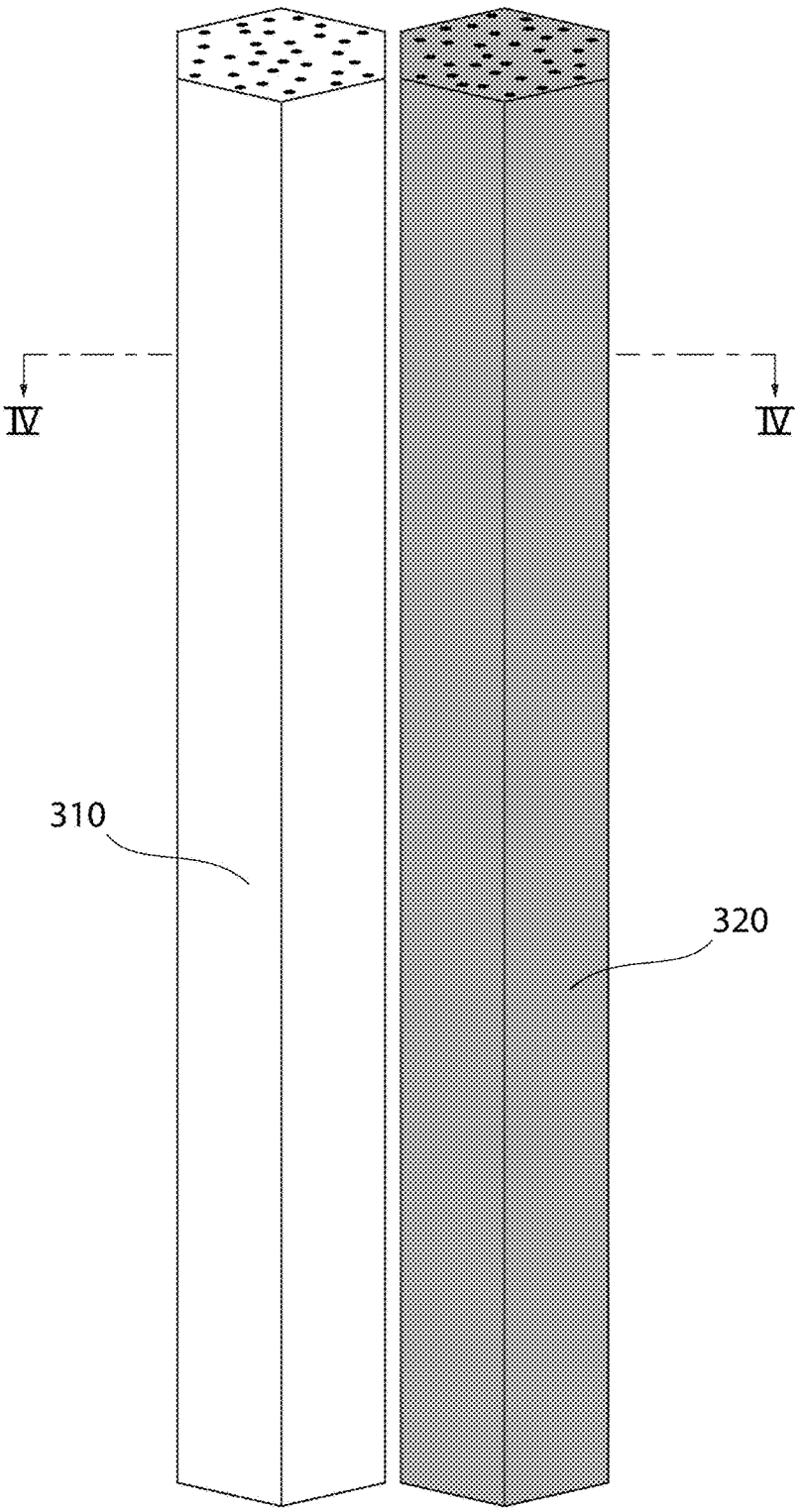
FIG. 3 is a front perspective view of a first strand component and a second strand component of a multi-component bristle in accordance with a second embodiment of the present invention.
Figure 4:
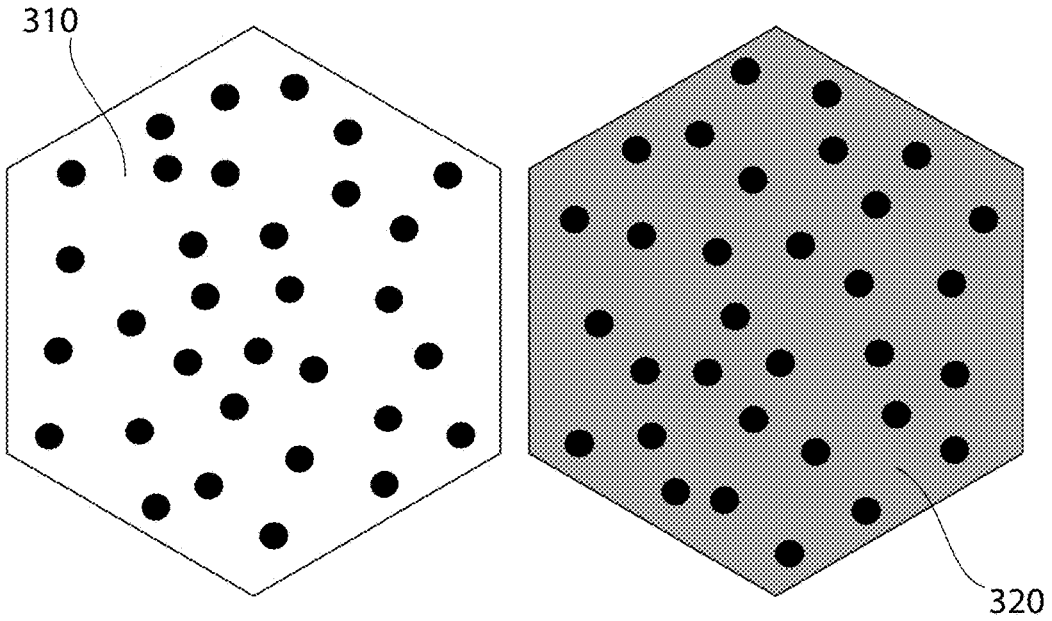
FIG. 4 is a cross-sectional view taken along line IV-IV of FIG. 3.

Referring now to FIGS. 3 and 4, a first strand component 310 and a second strand component 320 are illustrated as separate structures that have not been intertwined to form a spiral bristle. Thus, FIG. 3 does not illustrate a spiral bristle, but rather just the strand components 310, 320 that can be intertwined together to form a spiral bristle. In this embodiment, each of the first and second strand components 310, 320 has a hexagonal transverse cross-sectional shape. Of course, as discussed above the invention is not to be so limited and the first and second strand components 310, 320 can take on any polygonal shape as desired. The first and second strand components 310, 320 may have the same polygonal shape in some embodiments and may each have a different polygonal shape in other embodiments.

Figure 5A:
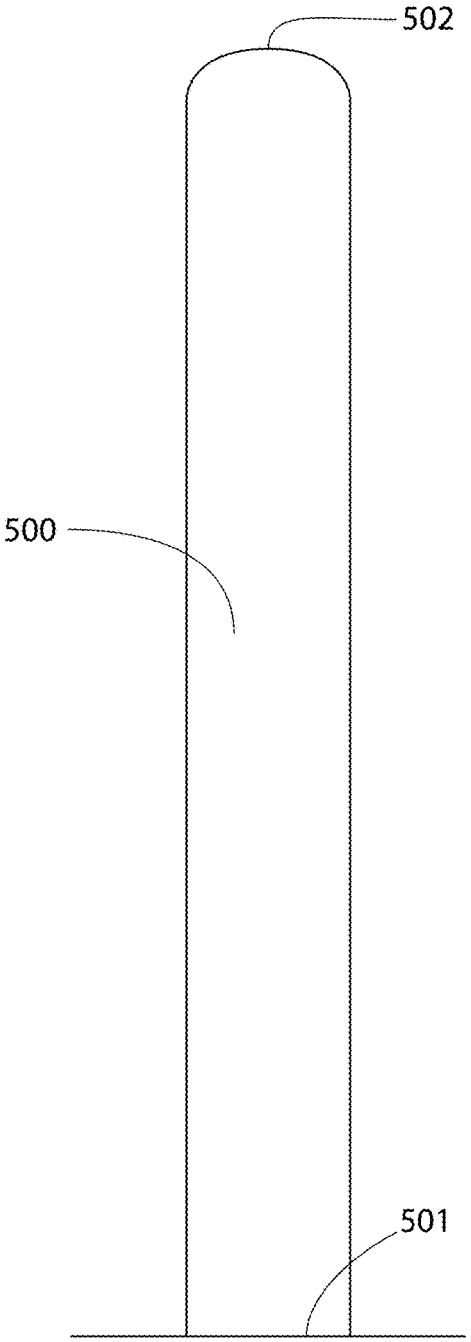
FIG. 5A is a schematic illustration of a bristle having a rounded tip.
Figure 5B:
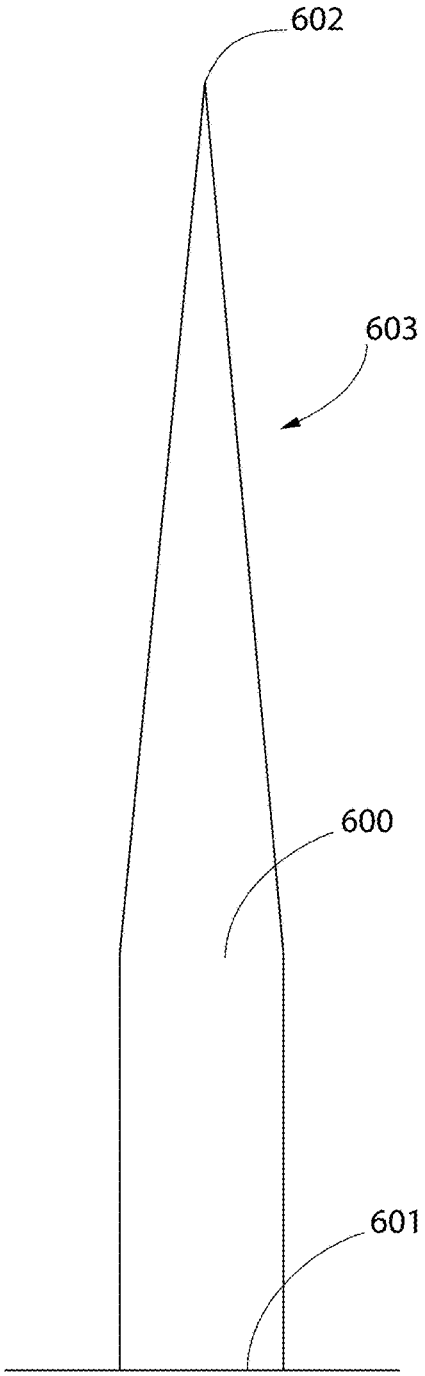
FIG. 5B is a schematic illustration of a bristle having a tapered tip.

Referring to FIGS. 5A and 5B, schematic illustrations are provided for spiral bristles. Specifically, FIG. 5A depicts a spiral bristle 500 (the spirals of which are not illustrated for clarity) having a first end 501 and a free end 502. The free end 502 of the spiral bristle 500 is rounded. FIG. 5B depicts a spiral bristle 600 (the spirals of which are not illustrated for clarity) having a first end 601 and a free end 602. The free end 602 of the spiral bristle 600 is tapered. Specifically, the spiral bristle 600 has a conical end portion 603 which includes the free end 602 and that decreases in transverse cross-sectional area moving toward the free end 602 of the spiral bristle 600. In the exemplified embodiment, the spiral bristle 600 begins to taper at a distance from the first end 601 that is approximately one-third of the height of the spiral bristle 600, and the free end 602 of the spiral bristle 600 is pointed rather than rounded. The exact nature, degree, amount and location of the taper is not to be limiting of the present invention unless so specified in the claims. Either one or both of the spiral bristles 500, 600 can be used on the oral care implement 100 described above so that the spiral bristles can be rounded or tapered to achieve a desired cleaning result and mouth feel. The spiral bristles 500, 600 having rounded and tapered free ends 502, 602, respectively, can be used as a part of the same tuft of bristles or different tufts of bristles on the same toothbrush head if desired.

In certain embodiments, the spiral bristle 600 having the tapered free end 602 can be formed by forming the first and second strand components of the spiral bristle 600 out of a plastic that is erodible by an etchant. In such embodiments, a chemical tapering process can be used to taper the spiral bristle 600 which includes dipping the spiral bristle 600 into an etchant to erode portions of the first and second strand components to taper the conical end portion 603 of the spiral bristle 600. Such a process leads to a conically tapering spiral bristle. In other embodiments, only one of the strand components may be formed of a plastic material that is erodible by an etchant and the other one of the strand components may be chemically resistant against the etchant. In such an embodiment, the first strand component will erode and taper when dipped into an etchant and the second strand component will maintain its structure when dipped into the etchant. This can create a single spiral bristle that has one tapered strand component and one non-tapered strand component. This can be accomplished by forming the first strand component out of a polyester such as PBT and forming the second strand component out of a polyamide such as nylon, as described above. Although the tapering is described above as a chemical tapering, the invention is not to be so limited. In other embodiments, the spiral bristle 600 can be mechanically tapered by any means known in the art.

Figure 6:
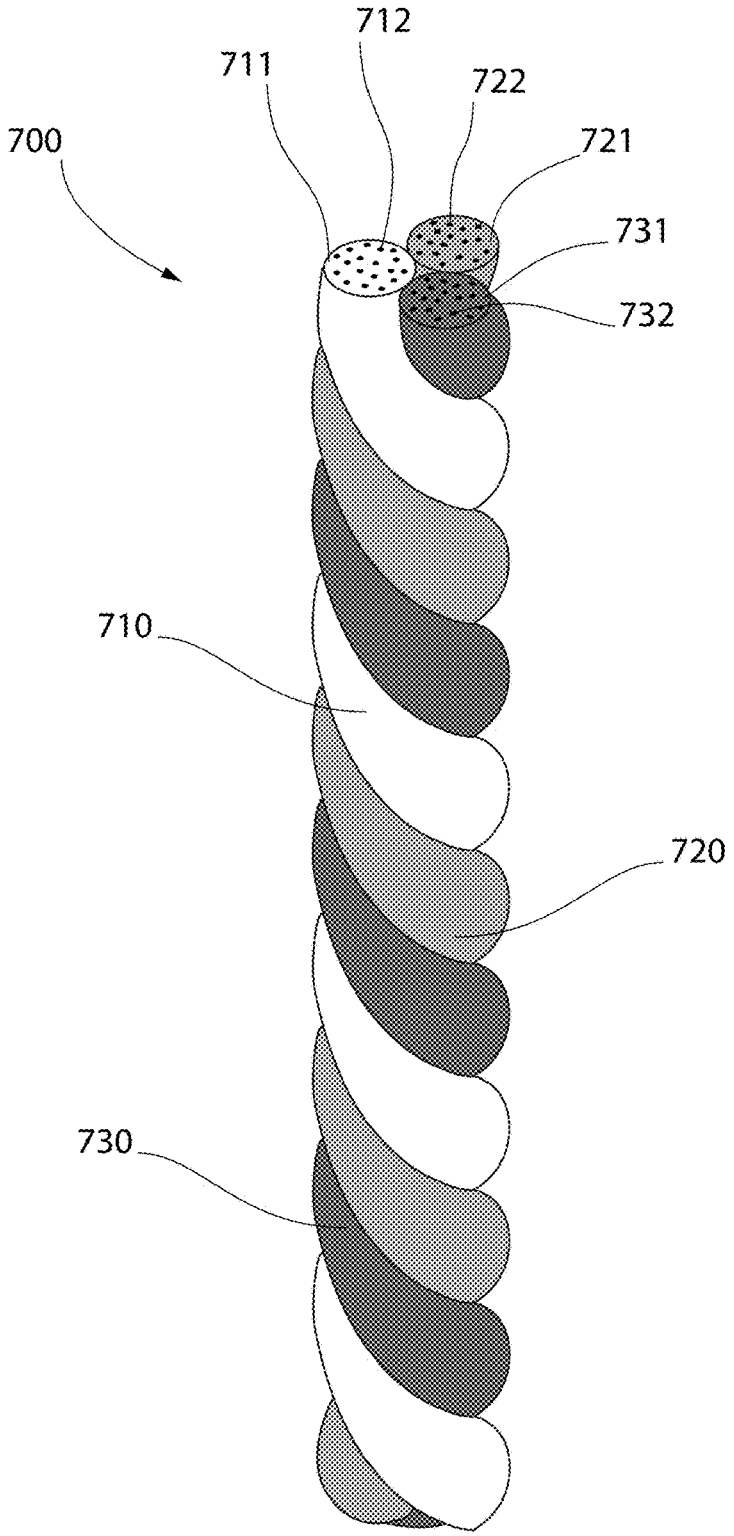
FIG. 6 is a front perspective view of a multi-component bristle in accordance with a third embodiment of the present invention.

Referring now to FIG. 6, a spiral bristle 700 in accordance with another embodiment of the present invention will be described. The spiral bristle 700 comprises a first strand component 710, a second strand component 720 and a third strand component 730 that are intertwined together to form the spiral bristle 700. In certain embodiments, each of the first, second and third strand components 710, 720, 730 can be coextruded and intertwined together to form the spiral bristle 700. The first strand component 710 can include a first plastic 711 and a first oral care additive 712, the second strand component 720 can include a second plastic 721 and a second oral care additive 722, and the third strand component 730 can include a third plastic 731 and a third oral care additive 732. In certain embodiments, the third oral care additive 732 may be different than the first and second oral care additives 712, 722, which are also different from each other. Thus, the spiral bristle 700 may include three different oral care additives to provide three different benefits to a user. Of course, the invention is not to be so limited in all embodiments and in certain other embodiments one or more of the oral care additives on the different strand components can be the same, or one or more of the strand components may be devoid of an oral care additive. Each of the first, second and third strand components 710, 720, 730 can be formed in the manner described above with regard to the spiral bristle 200.

Although not depicted, spiral bristles can also be formed having more than three strand components (i.e., four, five, six or more strand components), each of which has a different oral care additive or any combination of the same and different oral care additives. Thus, using the inventive spiral bristles described herein, an oral care implement can be created that can dispense/release many different oral care additives into a user's oral cavity simultaneously. A combination of different two strand component (or more strand component) spiral bristles can be utilized on the same oral care implement head wherein each strand component has different oral care agents. For example, an oral care implement may include tooth cleaning elements disposed in transverse rows on the head. Each transverse row may include bristle tufts including spiral bristles such that the spiral bristles in one transverse row include different oral care additives than the spiral bristles in each other or each adjacent transverse row. A virtually unlimited number of different combinations of the spiral bristles described herein are possible.

Figure 7:
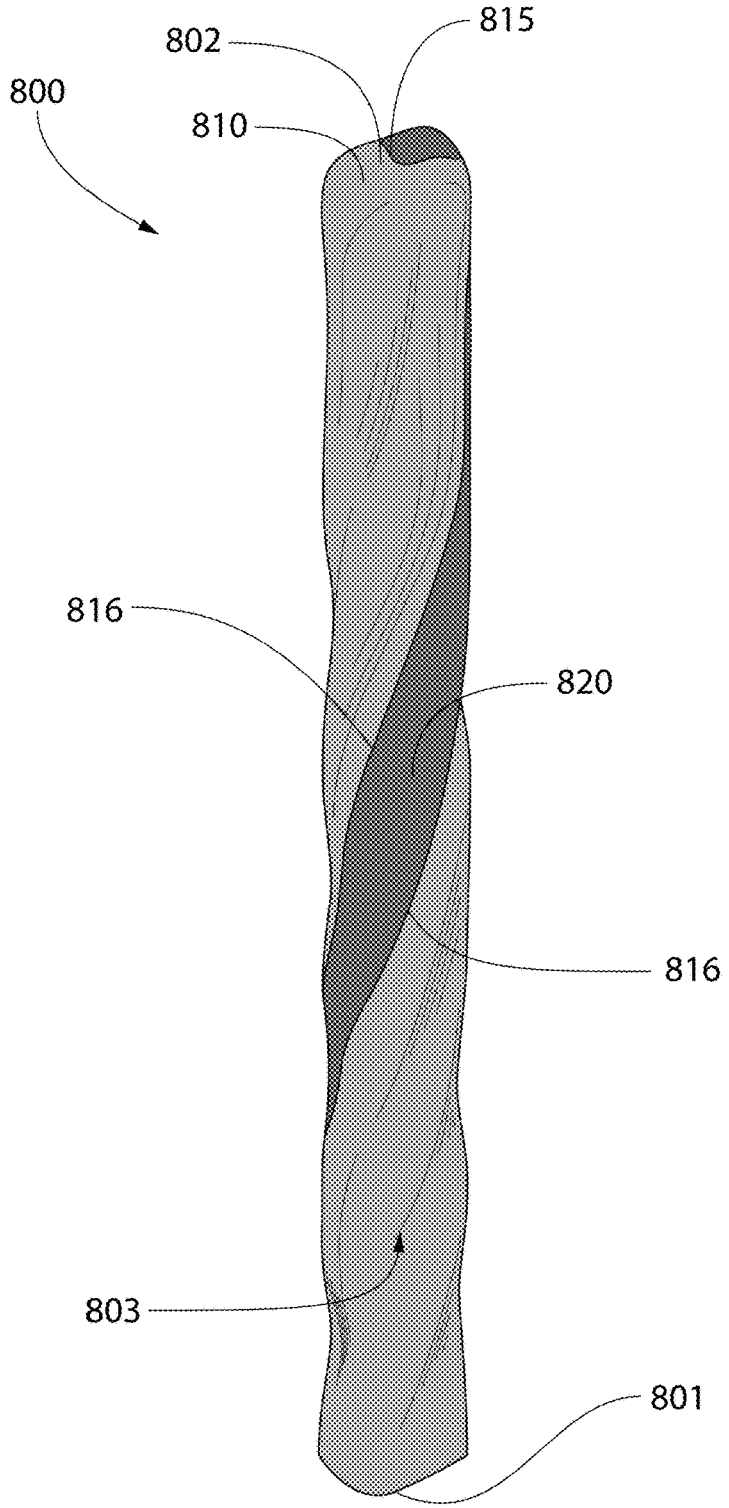
FIG. 7 is a front perspective view of a multi-component bristle in accordance with a fourth embodiment of the present invention.

Referring now to FIG. 7, another embodiment of a spiral bristle 800 is illustrated. The spiral bristle 800 has a first strand component 810 and a second strand component 820. Each of the first and second strand components 810, 820 are illustrated in different grayscale to illustrate that each of the first and second strand components 810, 820 can have different oral care additives therein. The oral care additive can be dispersed within the first and second strand components 810, 820 of the spiral bristle 800 in any of the manners discussed above. In this embodiment, the spiral bristle 800 has a smooth continuous outer surface 803 despite being formed by two separate strand components 810, 820. Specifically, the first strand component 810 is formed with a recess 815 within which the second strand component 820 fits like a lock-and-key. Thus, the first and second strand components 810, 820 are complementarily shaped so that when coextruded or otherwise made to form the spiral bristle 800, the spiral bristle 800 has the smooth outer surface 815. Stated another way, the seams 816 between the first and second strand components 810, 820 are flush so that there are no bumps, ridges or the like at the region of interconnection between the first and second strand components 810, 820. This is achieved due to the complementary shapes of the first and second strand components 810, 820 and can be achieved by coextruding the first and second strand components 810, 820 to form the spiral bristle 800 in certain embodiments. Although illustrated as having a constant exterior diameter, in certain embodiments the spiral bristle 800 may be tapered such that the exterior diameter decreases from its base 801 to its tip 802, such as discussed above with reference to FIG. 5B.

In certain embodiments, various combinations of the different types of spiral bristles discussed above can be used on a single toothbrush head. Thus, screw-type spiral bristles comprising two strand components such as depicted in FIG. 2, screw-type spiral bristles comprising three strand components such as depicted in FIG. 6, and smooth surface spiral bristles such as depicted in FIG. 7 can be disposed on the same toothbrush head, either in the same tuft hole or in different tuft holes. Thus, various combinations of the different embodiments disclosed herein can be utilized in a single invention.

Furthermore, although the invention has been described herein with regard to an oral care implement having at least one bristle tuft having at least one spiral bristle, in certain embodiments the inventive concept described herein is the spiral bristle itself. Thus, the invention can simply be a spiral bristle including coextruded first and second strand components that are intertwined together wherein the first strand component comprises a first plastic and a first oral care additive and the second strand component comprises a second plastic and a second oral care additive, the second oral care additive being different than the first oral care additive.

Figure 8:
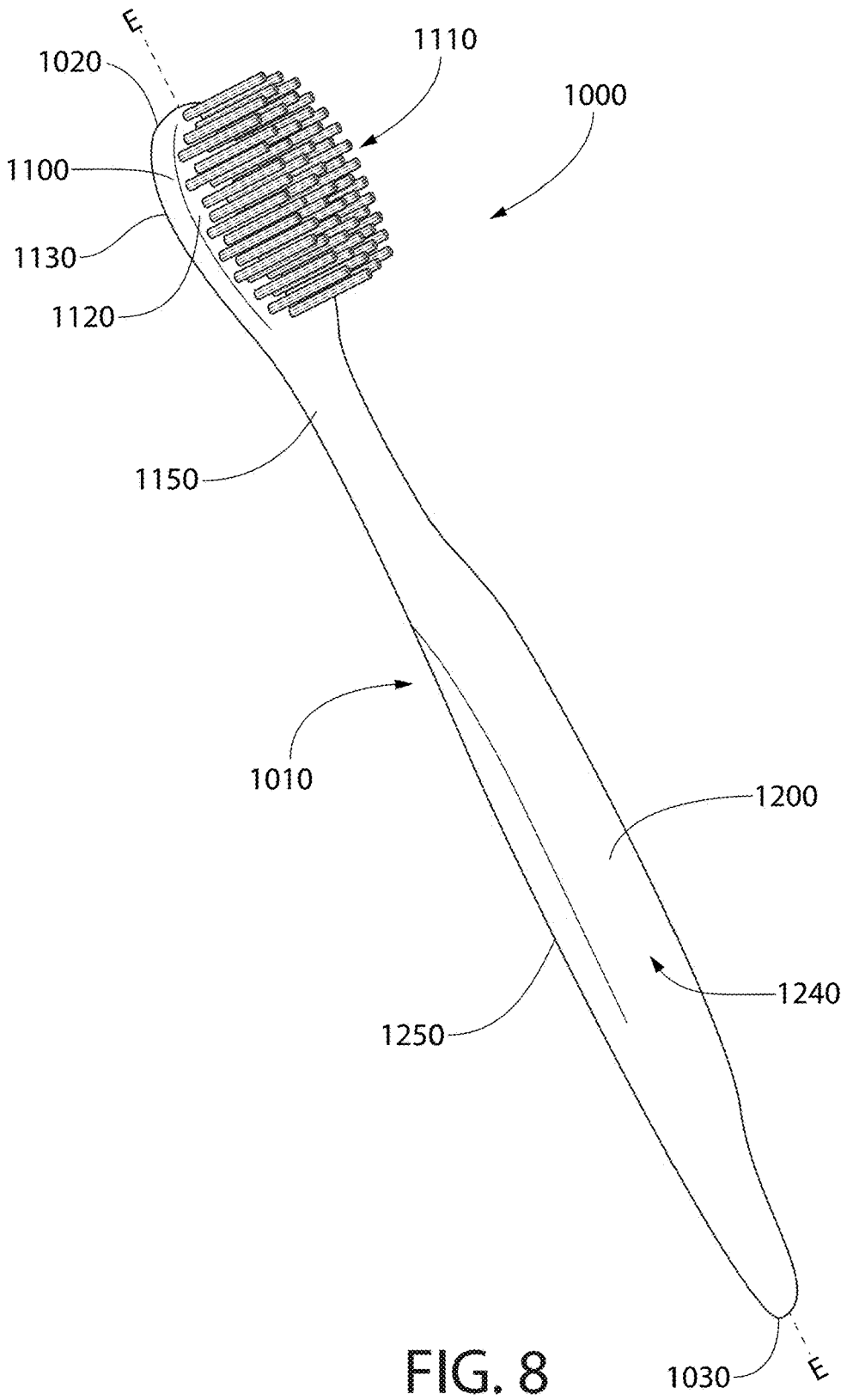
FIG. 8 is a front perspective view of an oral care implement having multi-component bristles according to another embodiment of the present invention.

Referring to FIG. 8, an oral care implement 1000 is illustrated in accordance with an embodiment of the present invention. In the exemplified embodiment, the oral care implement 1000 is in the form of a manual toothbrush. However, in certain other embodiments the oral care implement 1000 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 1030 to a distal end 1020 along a longitudinal axis E-E. The oral care implement 1000 generally includes an elongated body 1010 comprising a head 1100, a neck 1150 and a handle 1200. The handle 1200 is an elongated structure that provides the mechanism by which the user can hold and manipulate the oral care implement 1000 during use. The handle 1200 comprises a front surface 1240 and an opposing rear surface 1250. In the exemplified embodiment, the handle 1200 is generically depicted having various contours for user comfort. More specifically, in the exemplified embodiment the handle 1200 is bulbous shaped and has a larger diameter in a central region than near the proximal end 1030 and neck 1150. Specifically, a region of the handle 1200 that would normally be gripped by a user's thumb has a width that is greater than a width of the neck 1150. Of course, the invention is not to be so limited in all embodiments and in certain other embodiments the handle 1200 can take on a wide variety of shapes, contours and configurations, none of which are limiting of the present invention unless so specified in the claims.

In the exemplified embodiment, the handle 1200 is formed of a rigid plastic material, such as for example without limitation polymers and copolymers of ethylene, propylene, butadiene, vinyl compounds and polyesters such as polyethylene terephthalate. Of course, the invention is not to be so limited in all embodiments and the handle 1200 may include a resilient material, such as a thermoplastic elastomer, as a grip cover that is molded over portions of or the entirety of the handle 1200 to enhance the gripability of the handle 1200 during use. For example, portions of the handle 1200 that are typically gripped by a user's palm during use may be overmolded with a thermoplastic elastomer or other resilient material to further increase comfort to a user.

The head 1100 of the oral care implement 1000 is coupled to the handle 1200 and comprises a front surface 1120 and an opposing rear surface 1130. In the exemplified embodiment, the head 1100 is formed integrally with the handle 1200 as a single unitary structure using a molding, milling, machining or other suitable process. However, in other embodiments the handle 1200 and the head 1100 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners.

In the exemplified embodiment, the head 1100 of the oral care implement 1000 is provided with a plurality of tooth cleaning elements 1110 extending from the front surface 1120. Although in the exemplified embodiment all of the tooth cleaning elements 1110 appear to be the same, the invention is not to be so limited in all embodiments. For example, in certain embodiments the tooth cleaning elements 1110 include at least one bristle tuft comprising at least one multi-component bristle comprising a core component and a sheath component. The details of various structural forms for a multi-component bristle will be described in more detail below with reference to FIGS. 9-12.

A bristle tuft is a collection of bristles that are positioned together into a single tuft hole formed on the head 1100. Each bristle tuft may include, for example without limitation, only multi-component bristles, a combination of multi-component bristles and single-component (i.e., traditional) bristles, or only single-component bristles. In certain embodiments, the oral care implement 1000 may include one or more bristle tufts that include exactly one multi-component bristle and a plurality of single-component bristles or one or more bristle tufts that include only multi-component bristles. In still other embodiments, the tooth cleaning elements 1110 may all be formed as bristle tufts that are formed solely of multi-component bristles. Furthermore, in some embodiments the tooth cleaning elements 1110 may include some bristle tufts that are formed solely of single-component bristles and some bristle tufts that are formed solely of multi-component bristles, and the single-component bristle tufts and multi-component bristle tufts may be positioned on the head 1100 of the oral care implement 1000 in an alternating or non-alternating fashion (i.e., alternating or non-alternating transverse rows of bristle tufts, alternating or non-alternating longitudinal rows of bristles, or even alternating or non-alternating tufts in each row).

Other than including at least one bristle tuft comprising at least one multi-component bristle, the exact structure, pattern, orientation and material of the remainder of the tooth cleaning elements 1110 is not to be limiting of the present invention unless so specified in the claims. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 1110 of the present invention can be connected to the head 1100 in any manner known in the art. For example, staples/anchors, in-mold tufting (IMT) or anchor free tufting (AFT) could be used to mount the cleaning elements/tooth engaging elements. In certain embodiments, the invention can be practiced with various combinations of stapled, IMT or AFT bristles. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In the exemplified embodiment, the head 1100 of the oral care implement 1000 comprises a plurality of tuft holes (not visible) formed therein. A plurality of tufts of bristles are positioned within and affixed to the head 1100 within each of the tuft holes. Each of the tufts of bristles includes a plurality of bristles, which can be single strand bristles, double strand multi-component bristles, triple strand multi-component bristles, etc. or various combinations thereof. Thus, one tuft of bristles may include one double strand multi-component bristle and a plurality of single strand bristles or only double strand multi-component bristles or only triple strand multi-component bristles or a combination of single strand bristles, double strand multi-component bristles and triple strand multi-component bristles. Additionally, a single tuft hole may be filled with an elastomeric cleaning element or any of the other types of cleaning elements noted above. As noted above, in one embodiment at least one bristle tuft includes at least one multi-component bristle, which may be a double, triple or otherwise strand multi-component bristle. The details of the multi-component bristles will be discussed in more detail below with reference to FIGS. 9-12.

Although not illustrated herein, in certain embodiments the head 1100 may also include a soft tissue cleanser coupled to or positioned on its rear surface 1130. An example of a suitable soft tissue cleanser that may be used with the present invention and positioned on the rear surface of the head 1100 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 1000 may not include any soft tissue cleanser.

Figure 9A:
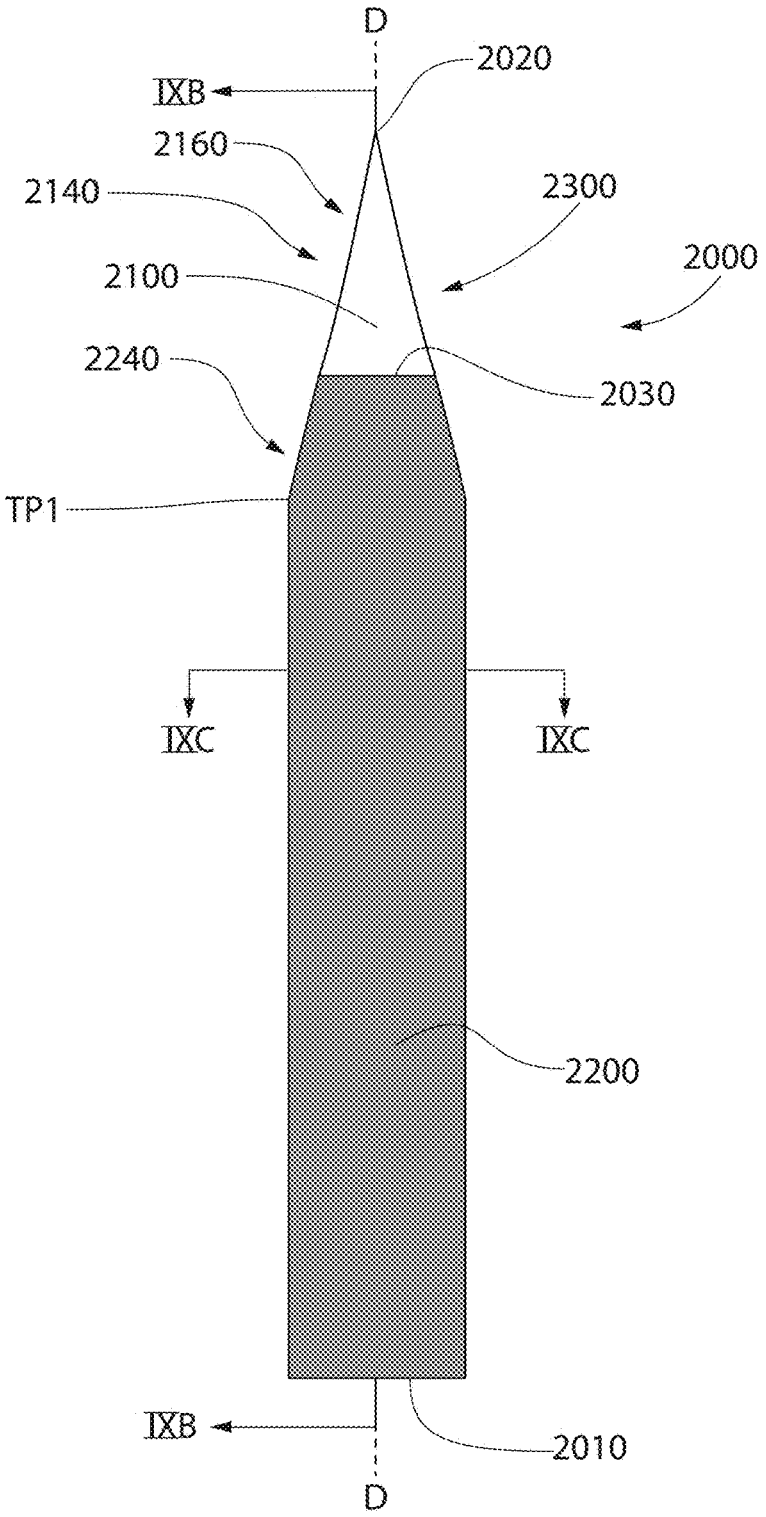
FIG. 9A is a front perspective view of a multi-component bristle in accordance with a fifth embodiment of the present invention.
Figure 9B:
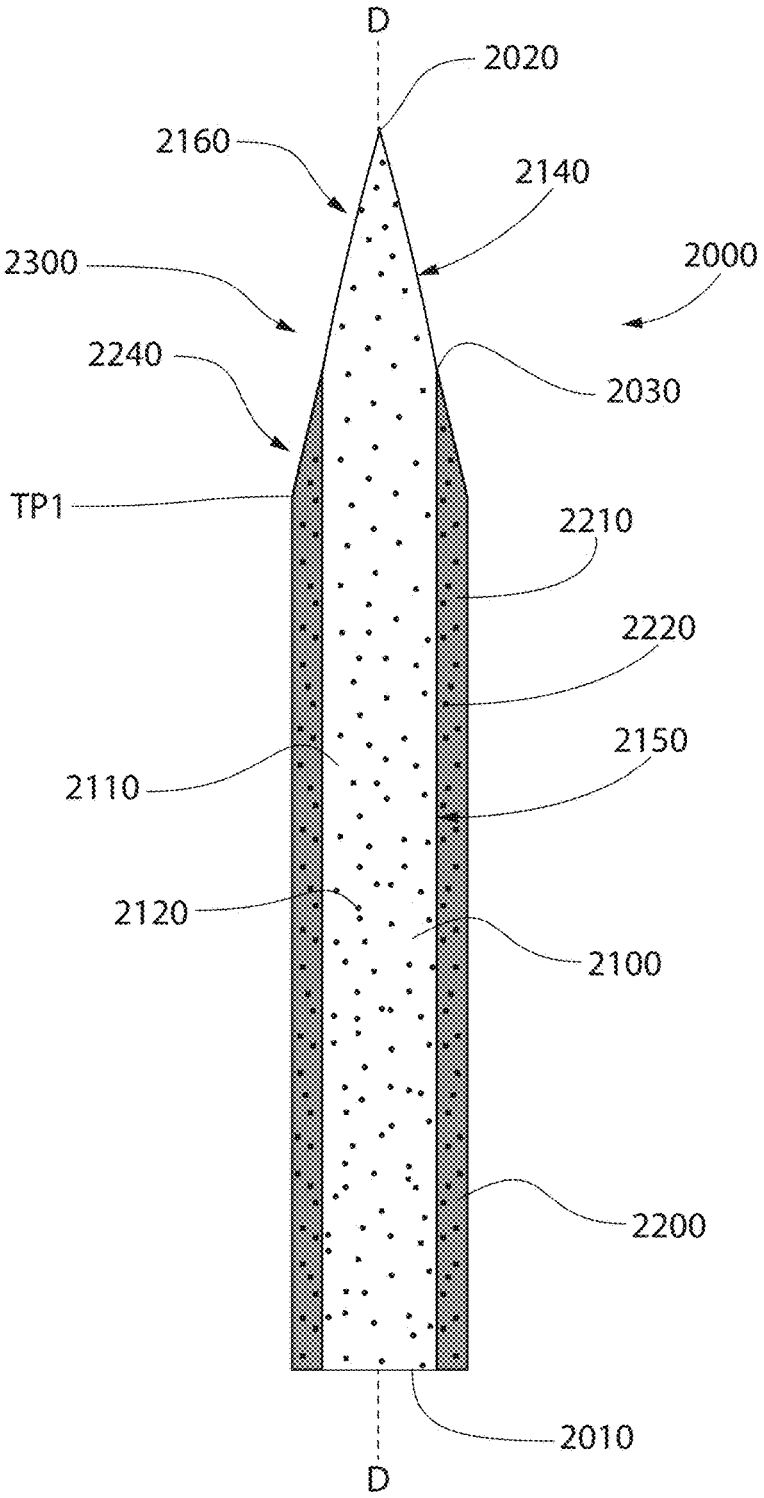
FIG. 9B is a cross-sectional view taken along line IXB-IXB in FIG. 9A.
Figure 9C:
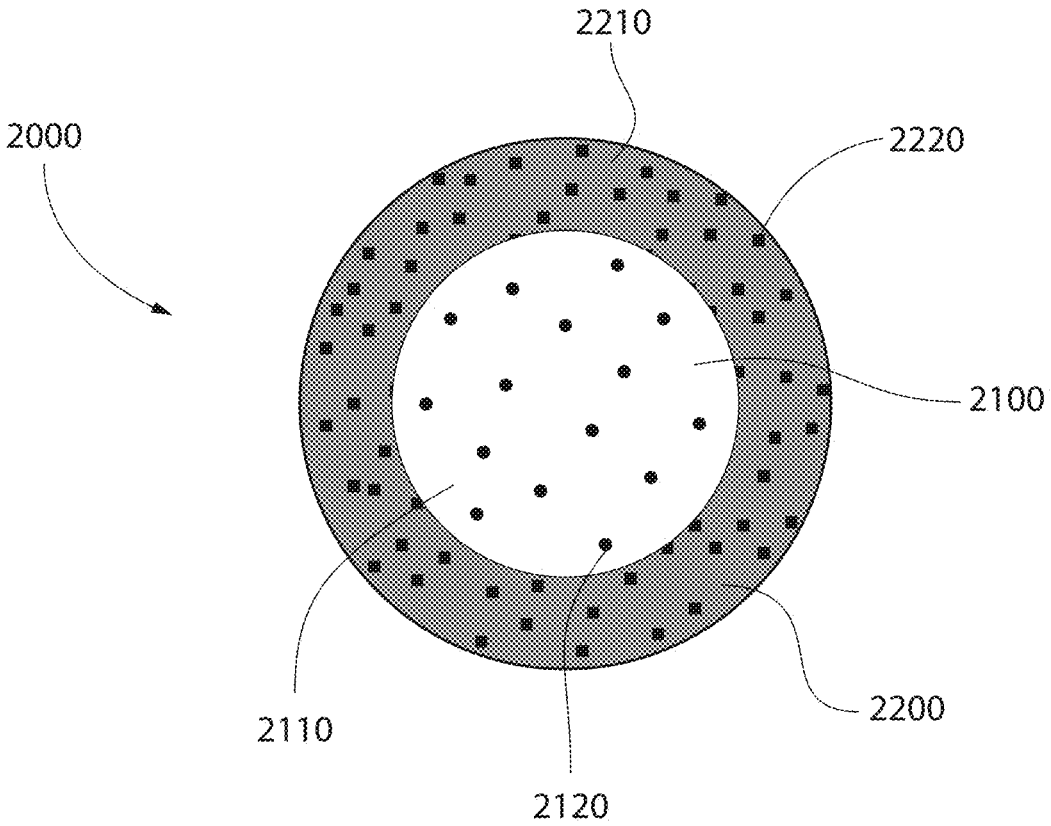
FIG. 9C is a cross-sectional view taken along line IXC-IXC in FIG. 9A.

Referring now to FIGS. 9A-9C concurrently, a multi-component bristle 2000 is illustrated in accordance with an embodiment of the present invention. The multi-component bristle 2000 extends from a base end 2010 to a free end 2020 along a longitudinal axis D-D. The multi-component bristle 2000 comprises a core component 2100 and a sheath component 2200 that are coextruded to form the multi-component bristle 2000. Stated another way, the multi-component bristle 2000 comprises the coextruded core and sheath components 2100, 2200. In the exemplified embodiment, the sheath component 2200 surrounds a first portion 2150 of the core component 2100 and a second portion 2160 of the core component 2100 protrudes from the sheath component 2200 at a tip portion 2300 of the multi-component bristle 2000. The second portion 2160 of the core component 2100 is therefore exposed whereas the first portion 2150 of the core component 2100 is not exposed. Thus, at least a portion of each of the core and sheath components 2100, 2200 is visible from an exterior of the multi-component bristle 2000, and more specifically an entirety of the sheath component 2200 is visible and the second portion 2160 of the core component 2100 is visible from the exterior of the multi-component bristle 2000.

In the exemplified embodiment, each of the core and sheath components 2100, 2200 extend all the way to the base end 2010 of the multi-component bristle 2000. The core component 2100 extends from the base end 2010 of the multi-component bristle 2000 to the free end 2020 of the multi-component bristle 2000. The sheath component 2200 extends from the base end 2010 of the multi-component bristle 2000 to a terminal end 2030 of the sheath component 2200. In the exemplified embodiment, the second portion 2160 of the core component 2100 makes up between approximately 15-20% of the total length of the multi-component bristle 2000, more specifically between approximately 17-23% of the total length of the multi-component bristle 2000, and even more specifically between approximately 20-22% of the total length of the multi-component bristle 2000. In another embodiment, the exposed second portion 2160 of the core component 2100 may make up between approximately 10-15%, and more specifically between approximately 12-13% of the total length of the multi-component bristle 2000. Furthermore, the sheath component 2200 extends approximately 75-80% of the total length of the multi-component bristle 2000, more specifically approximately 77-83% of the total length of the multi-component bristle 2000, and even more specifically between approximately 78-80% of the total length of the multi-component bristle 2000, or between approximately 85-90% or 87-88% of the total length of the multi-component bristle 2000.

In the exemplified embodiment, the multi-component bristle 2000 has a cylindrical cross-sectional shape. Furthermore, the core component 2100 has a cylindrical cross-sectional shape and the sheath component 2200 has a ring-like shape that circumferentially and concentrically surrounds the core component 2100 for at least part of the length of the core component 2100. Of course, the invention is not to be so limited and the core component 2100 can take on other polygonal shapes as desired and the shape of the sheath component 2200 can likewise change so long as the sheath component 2200 circumferentially surrounds the core component 2100 for at least a portion of the length of the core component 2100.

Due to the nature of multi-component bristle formation in that two or more components are coextruded to form the multi-component bristle 2000, these components can be used to house, store or otherwise contain oral care additives including oral care agents. Specifically, each of the core and sheath components 2100, 2200 can house the same oral care additive, a different oral care additive, or only one of the two or more components that forms the multi-component bristle 2000 can contain an oral care additive while the other of the two or more components may be devoid of an oral care additive. Thus, in certain embodiments two or more oral care additives can be housed separately on different components (i.e., core and sheath components) of a single multi-component bristle and can be made to intermix during use of the multi-component bristle (or oral care implement on which the multi-component bristle is disposed). Intermixing of two or more oral care additives can be beneficial so that a chemical reaction occurs within a user's oral cavity and so that in some circumstances a third oral care additive or agent can be formed by the reaction of the first and second oral care additives within the user's oral cavity.

Referring still to FIGS. 9A-9C, in certain embodiments the core component 2100 comprises a first plastic 2110 and a first oral care additive 2120 and the sheath component 2200 comprises a second plastic 2210 and a second oral care additive 2220, the second oral care additive 2220 being different than the first oral care additive 2210. In the exemplified embodiment, the oral care additive 2120 in the core component 2100 is illustrated as round dots and the oral care additive 2220 in the sheath component 2200 is illustrated as square dots to schematically illustrate that each of the core and sheath components 2100, 2200 contains a different oral care additive. Although described herein as the core and sheath components 2100, 2200 having different oral care additives, in certain embodiments each of the core and sheath components 2100, 2200 may have the same oral care additive, or one of the core and sheath components 2100, 2200 may be devoid of an oral care additive while the other of the core and sheath components 2100, 2200 has an oral care additive.

Figure 12A:
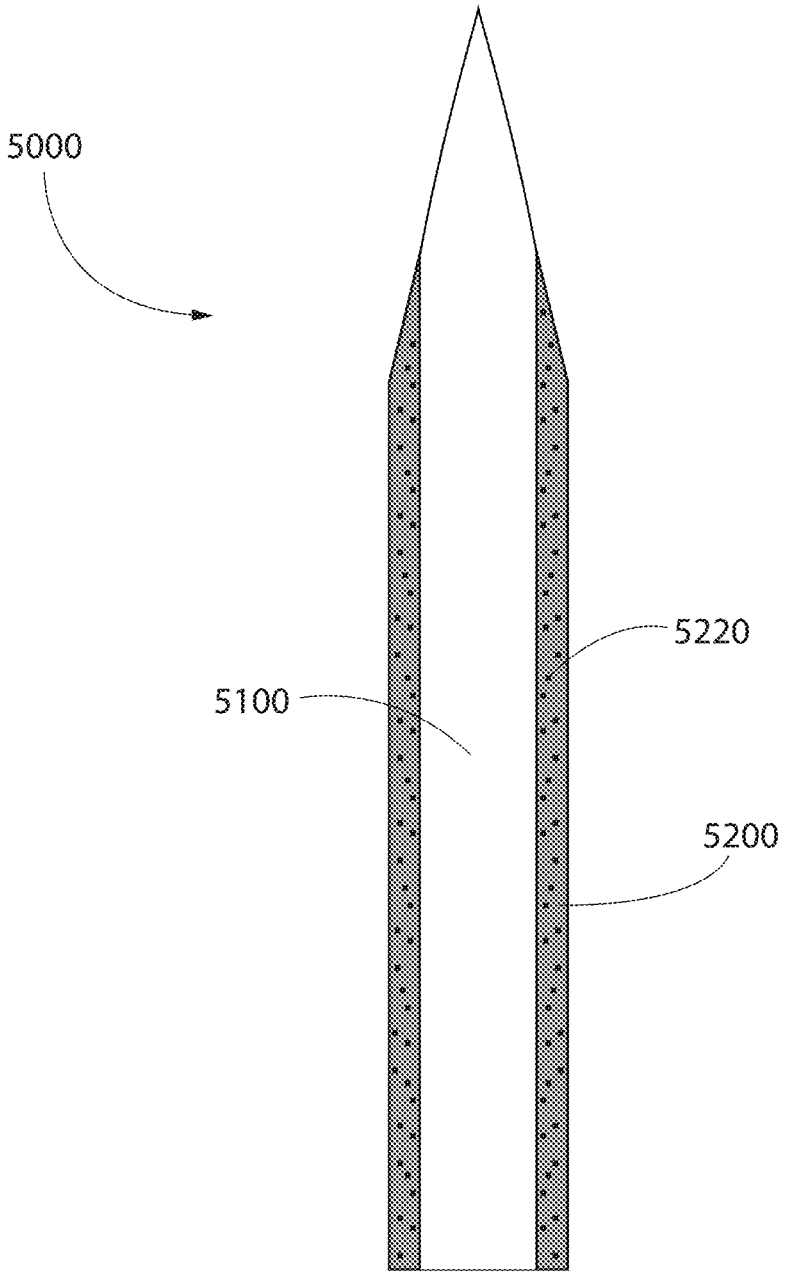
FIG. 12A is a first alternative embodiment of FIG. 9B.
Figure 12B:
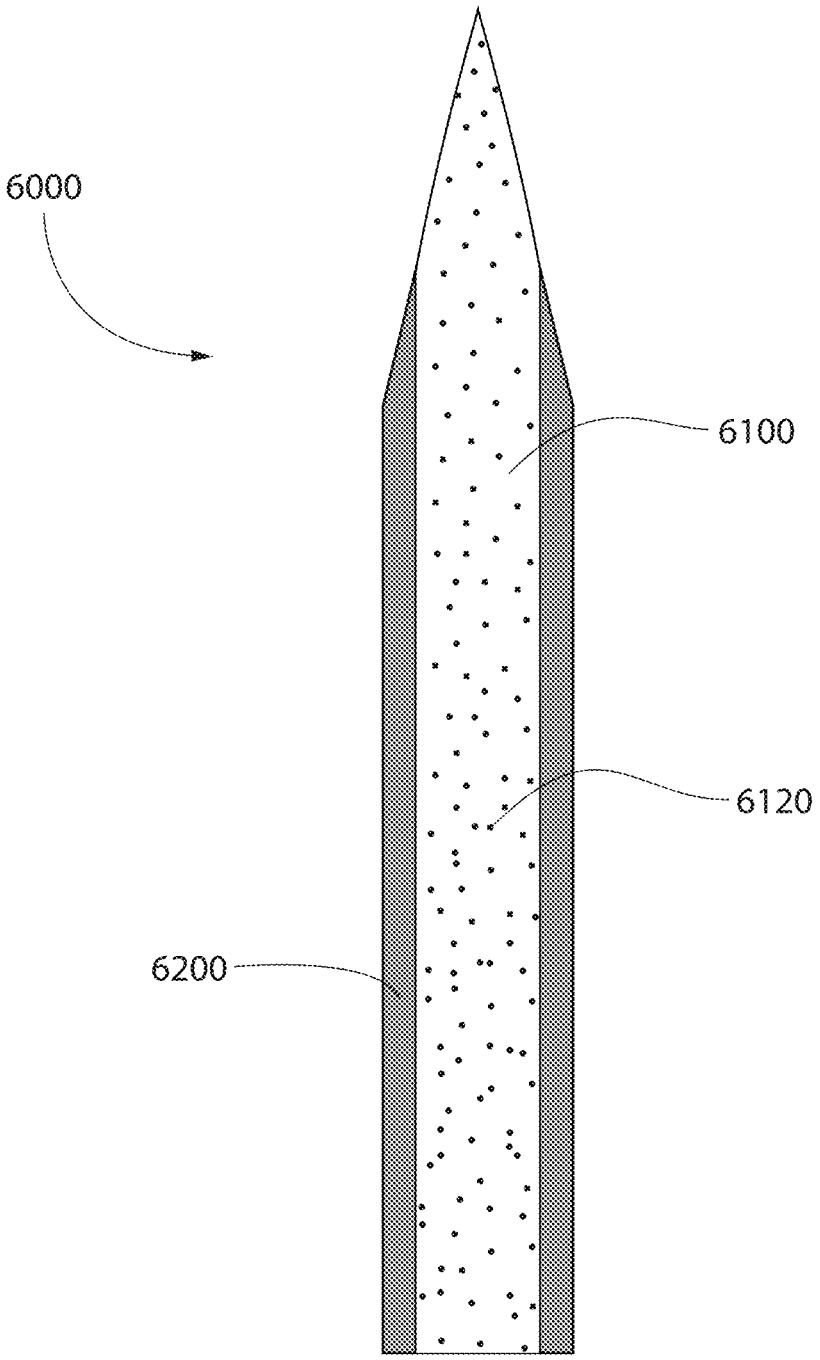
FIG. 12B is a second alternative embodiment of FIG. 9B.

Specifically, referring briefly to FIG. 12A, a longitudinal cross-sectional view of a multi-component bristle 5000 is illustrated that comprises a core component 5100 and a sheath component 5200. In this embodiment, the core component 5100 is devoid or free of an oral care additive and the sheath component 5200 comprises an oral care additive 5220. Furthermore, referring briefly to FIG. 12B, a longitudinal cross-sectional view of a multi-component bristle 6000 is illustrated that comprises a core component 6100 and a sheath component 6200. In this embodiment, the core component 6100 comprises an oral care additive 6120 and the sheath component 6200 is devoid or free of an oral care additive.

Referring back to FIGS. 9A-9C, in certain embodiments forming the core component 2100 is achieved by melting the first plastic 2110 and dispersing particles of the first oral care additive 2120 within the melted first plastic 2110. The particles of the first oral care additive 2120 are thereby mixed into the first plastic 2110 so that the core component 2100, when formed, will contain the first oral care additive 2120. Similarly, forming the sheath component 2200 is achieved by melting the second plastic 2210 and dispersing particles of the second oral care additive 2220 within the melted second plastic 2210. The particles of the second oral care additive 2220 are thereby mixed into the second plastic 2210 so that the sheath component 2200, when formed, will contain the second oral care additive 2220. As noted above, the first and second oral care additives 2120, 2220 can be the same or different.

Upon cooling, the first and second melted plastics 2110, 2210 will become hardened and the first and second oral care additives 2120, 2220 will be housed, contained or dispersed within the respective first and second plastics 2110, 2210. Next, in certain embodiments the first and second plastics 2110, 2210 can be coextruded to form the multi-component bristle 2000 from the core and sheath components 2100, 2200. Alternatively, the first plastic 2110 with the first oral care additive 2120 therein can be formed into the core component 2100 and the second plastic 2210 with the second oral care additive 2220 therein can be separately formed into the sheath component 2200 (either by separate extrusion processes or any other bristle strand forming process now known or later developed), and then the core and sheath components 2100, 2200 can be coupled together to form the multi-component bristle 2000. In either case, the multi-component bristle 2000 is formed from the core and sheath components 2100, 2200, each of which contains a different (or the same) oral care additive or agent therein. Of course, as noted above, one of the core and sheath components 2100, 2200 may be formed without dispersing an oral care additive therein if desired.

In other embodiments, the oral care additives need not be applied to the melted plastics in particle form. Rather, in certain embodiments the oral care additives 2120, 2220 can be added to the respective core and sheath components 2100, 2200 by forming the core and sheath components 2100, 2200 with a tactile or sticky texture to hold the oral care additives 2120, 2220 thereon, or by forming the core and sheath components 2100, 2200 with grooves, ledges, holes, hollows or other features and/or surface structure, shape or configuration that facilitates the housing of a powder, liquid, gel, paste or other form of oral care additive. In such embodiments, the oral care additive can be attached to or otherwise interspersed within the core and sheath components 2100, 2200 after formation thereof. Regardless of the manner of forming the multi-component bristle 2000 with oral care additives therein, the oral care additives 2120, 2220 are releasable from the first and second plastics 2110, 2220 and from the core and sheath components 2100, 2200 of the multi-component bristle 2000, particularly during use of the oral care implement 1000 as will be described in more detail below, in order to provide oral health benefits to a user.

Furthermore, in certain embodiments the oral care additives, in any form (i.e., particle, powder, liquid, gel, paste etc.), may be embedded or housed within or otherwise carried by one or more carriers which are then formed into, housed or contained within the core and sheath components 2100, 2200. Specifically, the first oral care additive 2120 may be carried by a first carrier and the second oral care additive 2220 may be carried by a second carrier. In one embodiment, each of the first and second carriers may be one or more water-soluble polymers. In such an embodiment, the oral care additives 2120, 2220 may be carried by, disposed within or embedded within the one or more water-soluble polymers, and then the water-soluble polymers can be added to the melted plastic that is used to form the core and sheath components 2100, 2200 as described above. In this manner, the carriers will be mixed or formed into the plastic material that forms the core and sheath components 2100, 2200, the carriers carrying the oral care additives. In such embodiments, it may be desirable for the first carrier to have a higher melting point than the melting point of the first plastic 2110 and for the second carrier to have a higher melting point than the melting point of the second plastic 2210 so that the carrier or water-soluble polymer maintains its structure and retains the oral care additive therein when being added to the melted plastic. As the plastic cools and hardens, the carriers may then be contained or dispersed within the plastic as the plastic is formed into the core and sheath components 2100, 2200.

In certain embodiments, an outer surface of the carriers may blend with the plastic material of the core and/or sheath components 2100, 2200 to ensure that the carriers are maintained on the multi-component bristle 2000 until use. Specifically, an outer surface of the carriers may partially melt along with the plastic so that when the plastic hardens, the carrier hardens along with it and the plastic and the carriers become at least partially integrally coupled together.

In certain embodiments, each of the first and second carriers can comprise one or more degradable or dissolvable capsules that carry, contain or encapsulate the first and second oral care additives 2120, 2220 therein. The capsules may be soluble in liquid, such as saliva, to release the oral care additives 2120, 2220 contained therein during use of the oral care implement 100. Stated another way, the capsules degrade when subjected to moisture and thus dissolve when mixed with the saliva of the user to release its contents. Alternatively, the capsules may have frangible, thin walls that break, rupture or burst to release the oral care additives 2120, 2220 contained therein during use due to being contacted by or rubbed against the user's teeth. In other embodiments, each of the first and second carriers can comprise one or more matrices that carry the first and second oral care additives 2120, 2220. Similar to the capsules, the matrices may also dissolve or break to release the oral care additives 2120, 2220 contained therein during use of the oral care implement 1000. In other embodiments, one of the first and second carriers can comprise one or more capsules carrying the first oral care additive and the other of the first and second carriers can comprise one or more matrices carrying the second oral care additive, or each of the first and second carriers may comprise a combination of capsules and matrices that carry the respective oral care additives.

Using the carriers to house the oral care additives may assist in ensuring that the oral care additives are properly retained on the core and sheath components 2100, 2200 and released into a user's oral cavity during use of the oral care implement 1000. Specifically, in embodiments wherein the carriers are water-soluble polymers, such carriers/water-soluble polymers will degrade, shrink or dissolve in the user's saliva during use of the oral care implement, thereby releasing the oral care additives from the carriers and into a user's oral cavity. The solubility of such water-soluble polymers can be selected as desired to create a multi-component bristle having immediate release of all of the oral care additives contained therein or a timed release of the oral care additives contained therein.

In certain embodiments the first and/or second carriers may be formed for timed or slow release of the oral care additives contained therein so that the benefits of the oral care additives can be obtained by the user over many uses of the oral care implement 1000. In one embodiment, the carriers may degrade over a period of three months so that upon the entire oral care additive having been released into the user's oral cavity during brushing, the user will know that it is time to replace the toothbrush. In certain embodiments, the core and sheath components 2100, 2200 of the multi-component bristle 2000 may change color upon the oral care additive contained therein being depleted to visually communicate to a user that toothbrush replacement is needed. Thus, the multi-component bristles 2000 can serve as both oral care additive containment/dispensing structures and as a wear indicator.

In other embodiments, the core component 2100 may include first carriers (i.e., water-soluble polymers) that degrade or dissolve within a first temporal period of time and the sheath component 2200 may include second carriers (water-soluble polymers) that degrade or dissolve within a second temporal period of time so that the oral care additives within the second carriers do not begin to be released until the entirety of the oral care additives within the first carriers have been released. Thus, the second carriers will not begin to dissolve until the entirety of the first carriers has dissolved, such that the first carriers will have a higher solubility than the second carriers. In other embodiments, the first and/or second carriers may completely erode, degrade, shrink or dissolve during a first use so that the entirety of the oral care additives contained therein is released into the user's oral cavity during a single use. In such embodiments, the oral care implement 1000 may be a disposable or single use toothbrush.

The first and second oral care additives 2110, 2210 can be any of a variety of oral care additives that provide proven benefits to a user's oral health. Such oral care additives include, without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+. The lotus seed is the extract from lotus seeds and is a natural herb for anti-heating and the prevention of gum bleeding. The lotus flower is the extract from the lotus flower and is a natural herb for anti-heating and the prevention of gum bleeding. Bamboo salt is the combination of a bamboo extract and salt and is used to diminish inflammation and has anti-bacterial effects. Jasmine is an extract from the jasmine flower and is a natural herb for anti-heating, preventing gum bleeding and for mouth freshening. Corn mint is an extract from a corn mint leaf and is a natural herb for anti-heating, anti-bacterial uses and mouth freshening. Camellia is an extract from the camellia flower and is a natural herb for anti-heating and the prevention of gum bleeding. Aloe is an extract from the aloe leaf and is a natural herb for inflammation reduction and has anti-bacterial effects. Gingko is an extract from the gingko leaf and is a natural herb for inflammation reduction and has anti-bacterial effects. Tea tree oil is an extract from a tea tree and is a natural herb for diminishing inflammation and has anti-bacterial effects. Xylitol is an extract from plants such as corn, sugar cane, oak, birch, etc. and can be used for preventing tooth decay. Sea salt is an extract from the sea and can be used to reduce inflammation and has anti-bacterial effects. Vitamin C is an extract from food and can be used to prevent gum bleeding and as an antioxidant. Ginger is an extract from ginger and is a natural plant for diminishing inflammation and has anti-bacterial effects. Cactus is an extract from a cactus and it a natural plant for reducing inflammation and can be used as an antioxidant. Backing soda is a chemistry product and can be used as an enamel protectant. Pine tree salt is a mixture of the extract from pine trees and salt and is an ancient Chinese medicine for preventing inflammation and anti-heating. Green tea is an extract from the green tea leaf and is a natural herb to prevent halitosis and inhibit bacteria growth. White pearl is a kind of pearl powder and can be used for teeth whitening and teeth health improvement by calcium absorption. Black pearl is a kind of pearl powder that can be used for teeth whitening, cleaning and stain removal. Charcoal is made from an oak tree by carbonization and it helps to for moisture adjustment and to reduce the growth of bacteria. Nephrite (jade) is a kind of nephrite powder and can be used to prevent gum disease and boost the blood circulation of the gums. Ag/Au is an anti-bacterial additive contained in the Ag/Au ion (i.e., silver/gold) and can be used to inhibit bacterial growth. In certain embodiments, each of the first and second oral care additives are selected from a group consisting of a mixture of pine tree extract and salt, a tea leaf extract, a pearl powder, a nephrite powder, a charcoal powder, and an antibacterial material. In some embodiments, the oral care additives are natural ingredients. In one specific embodiment the oral care additive is charcoal, particularly in the embodiments of FIGS. 12A and 12B wherein one of the core and/or sheath components 2100, 2200 is free of an oral care additive.

In certain embodiments, each of the core and sheath components 2100, 2200 may have a different color to provide both a visual aesthetic and to communicate information about the oral care additive contained on that particular component to a user. In the exemplified embodiment, the core component 2100 is illustrated as being white in color and the sheath component 2200 is illustrated as being gray in color. The white and gray colors are merely used to indicate that each of the core and sheath components 2100, 2200 can be a different color, but are not intended to indicate a specific color. In certain embodiments, the core component 2100 can be any color (e.g., white, red, blue, green, yellow, orange, etc.) and the sheath component 2200 can also be any color (e.g., white, red, blue, green, yellow, orange, etc.). Although depicted as being different colors in the drawings, in certain embodiments each of the core and sheath components 2100, 2200 can be the same color.

Furthermore, in certain embodiments the color of the core and/or sheath components 2100, 2200 of the multi-component bristle 2000 can be used to indicate a flavor of that particular component or a trigeminal effect that will be imparted to the user by that particular component. Thus, for example, a multi-component bristle may include a core component that contains an orange flavored oral care additive and a sheath component that contains a lemon flavored oral care additive. In such an embodiment, the core component may be orange in color and the sheath component may be yellow in color to visually communicate their respective flavors to a user. Similarly, a multi-component bristle may include a core component that has a green tea extract and a sheath component that includes black pearl. In such an embodiment, the core component may be green in color and the sheath component may be black in color to visually communicate their respective oral care additives to a user. Similarly, the color blue can be used to inform a user that a particular component will provide a cooling trigeminal effect to the user, the color red can be used to inform a user that a particular component contains an oral care additive that will boost blood circulation, the color purple can be used to inform a user that a particular component contains an anti-inflammatory oral care additive, etc. Color-coding the strand components of the multi-component bristles provides a desirable visual aesthetic as well as being informative for the user or consumer. The oral care implement on which the multi-component bristles are contained may include a color-coded key on its handle, head, packaging or on a separate instruction/information sheet that is provided with the oral care implement to inform the user of the message that the various colored components are intended to convey.

In certain embodiments, any of one or more of the above oral care additives can be included into each of the core and sheath components 2100, 2200 that are used to form the multi-component bristle 2000. However, in certain embodiments one of the above oral care additives is included into the core component 2100 and a second one of the above oral care additives is included into the sheath component 2200, the second one of the above oral care additives being different than the first one of the above oral care additives. In certain embodiments, the first and second oral care additives may each have an agent that is selected so that during brushing the agents of the first and second oral care additives mix together to form a third oral care additive or agent. Specifically, prior to brushing the first oral care additive will remain chemically isolated from the second oral care additive despite the first and second oral care additives being on the same multi-component bristle 2000 because the first oral care additive is formed into or carried by the core component 2100 and the second oral care additive is formed into or carried by the sheath component 2200. During brushing, the core and sheath components 2100, 2200 will get wet, which enables the first oral care additive 2120 (or a portion thereof) to be released from the core component 2100 and the second oral care additive 2220 (or a portion thereof) to be released from the sheath component 2200. When the first and second oral care additives 2120, 2220 are simultaneously released, the agents within those oral care additives may intermix within the user's oral cavity to form a third agent in some embodiments.

Intermixing of the first and second oral care additives within the user's oral cavity can be beneficial in certain instances. Specifically, certain agents, medicaments, anesthetics, antimicrobial agents, polishes, whiteners and other miscellaneous agents, substances and chemicals lose effectiveness over time. Thus, it may be desirable to apply such substances substantially immediately after their formation. Using the core and sheath components 2100, 2200 of the multi-component bristle 2000 as the structures on which the oral care additives are housed facilitates this intermixing within the user's oral cavity.

As noted above, the two oral care additives can be selected so that they form a third oral care additive or agent upon intermixing within a user's oral cavity. Some reactions that may occur include: (1) mixing a base with an acid to form a neutral; (2) mixing a base with a curing agent to form an epoxy resin; (3) mixing Bisphenol F with Epichchlorhydin to form diglycidyl ether of bisphenoal A (epoxy resin); (4) mixing calcium carbonate with hydrogen peroxide to form peroxide; (5) mixing water with hydrogen peroxide to form peroxide; (6) mixing potassium nitrate with stannous fluoride to form a sensitivity agent; (7) mixing chlorhexadine with silica to form an antimicrobial agent; (8) mixing cetylpyridinium chloride with silica to form an antimicrobial agent; (9) mixing tricolsan with pyrophosphate to form an antimicrobial agent; and (10) mixing a first flavor with a second flavor to form a third flavor. Thus, various oral care additives/agents can be formed that are known for tooth whitening, cleaning, antimicrobial, antibacterial, taste or other desired effects.

As noted above, the core component 2100 is formed of the first plastic 2110 and the sheath component 2200 is formed of the second plastic 2210. In certain embodiments, each of the first and second plastics 2110, 2210 is the same. In such embodiments, both of the first and second plastics 2110, 2210 may be erodible by an etchant or neither of the first and second plastics 2110, 2210 may be erodible by the etchant. However, in other embodiments the first and second plastics 2110, 2210 are different. In one particular embodiment, the first plastic 2110 is erodible by an etchant and the second plastic 2210 is chemically resistant by the etchant. Furthermore, in one embodiment the first plastic 2110 is a polyester, such as polybutylene terephthalate (PBT), and the second plastic 2210 is a polyamide, such as nylon. Of course, the invention is not to be limited by the particular materials that are used to form the core and sheath components 2100, 2200 unless so specified in the claims.

In the embodiment exemplified in FIGS. 9A-9C, both the core and sheath components 2100, 2200 of the multi-component bristle 2000 are tapered. Specifically, the sheath component 2200 has a tapered section 2240 and the core component 2100 has a tapered section 2140. Thus, the tip portion 2300 of the multi-component bristle 2000 has a conical shape that decreases in transverse cross-sectional area moving from a transition point TP1 to the free end 2020 of the multi-component bristle. In the exemplified embodiment, the transition point TP1 is the point on the multi-component bristle where the sheath component 2200 begins to taper. Furthermore, the core component 2100 begins to taper at the terminal end 2030 of the sheath component 2200. This is because, in certain embodiments, the core component 2100 cannot taper between the terminal end 2030 of the sheath component 2200 and the base end 2010 of the multi-component bristle 2000 because the core component 2100 is covered by the sheath component 2200 in that area. Thus, in particular when chemical etching is used to taper the multi-component bristle 2000, only the exposed second portion 2160 of the core component 2100 will be tapered.

In the exemplified embodiment, the taper is continuous from the transition point TP1 to the free end 2020 of the multi-component bristle 2000. Thus, the reduction in cross-sectional area from the transition point TP1 to the free end 2020 is constant and continuous, which results in a smooth transition between the sheath component 2200 and the core component 2100. In other words, the core component 2100 begins to taper where the sheath component 2200 ends so that there are no bumps, ridges, edges, points or grooves in the location between the core and sheath components 2100, 2200, but rather simply a smooth transition. State another way, the transverse cross-sectional area of the sheath component 2200 at the terminal end 2030 of the sheath component 2200 is identical to the cross-sectional area of the core component 2100 at the terminal end 2030 of the sheath component 2200. Due to the core component 2100 beginning to taper exactly at the terminal end 2030 of the sheath component 2200, the tip portion 2300 of the multi-component bristle 2000 has a continuous, uninterrupted taper despite being formed partially by the sheath component 2200 and partially by the core component 2100.

In the exemplified embodiment, the tip portion 2300 of the multi-component bristle 2000 is formed by the tapered section 2140 of the core component 2100 and the tapered section 2240 of the sheath component 2200. In the exemplified embodiment, the core component 2100 forms a larger part of the tip portion 2300 of the multi-component bristle 2000 than the sheath component 2200. Specifically, in the exemplified embodiment the tapered section 2140 of the core component 2100 has a greater length than the tapered section 2240 of the sheath component 220 (measured either vertically along the longitudinal axis D-D or measured along the outer boundary/outer surface of the multi-component bristle 2000). However, the invention is not to be so limited in all embodiments and in certain other embodiments the core and sheath components 2100, 2200 can each form the same amount (i.e., percentage of the length) of the tip portion 2300, or the sheath component 2100, 2200 can form a greater part of the tip portion 2300 of the multi-component bristle 2000 than the core component 2100.

In the exemplified embodiment, each of the first and second plastics are formed of a polyester so as to be erodible by an etchant such that the conical shape of the tip portion 2300 of the multi-component bristle 2000 is formed by chemical etching. Thus, if the multi-component bristle 2000 is placed into an etchant from the free end 2020 to the transition point TP1 and slowly removed therefrom, the multi-component bristle 2000 will taper from the transition point TP1 to the free end 2020, and more specifically the sheath component 2200 will taper from the transition point TP1 to the terminal end 2030 of the sheath component 2200 and the core component 2100 will taper from the terminal end 2030 of the sheath component 2200 to the free end 2020 of the multi-component bristle 2000. In the exemplified embodiment the core component 2100 has a constant transverse cross-sectional area from the base end 2010 of the multi-component bristle 2000 to the terminal end 2030 of the sheath component 2200 and the sheath component 2200 has a constant transverse cross-sectional area from the base end 2010 of the multi-component bristle 2000 to the transition point TP1. Of course, other configurations are possible, such as varying transverse cross-sectional areas of each of the core and sheath components 2200, 2300 along the length of the multi-component bristle 2000.

Of course, the invention is not to be so limited in all embodiments and in certain other embodiments the conical shape of the tip portion 2300 can be formed by mechanical grinding or any other means. Regardless of the manner of creating the taper/conical shape, in the exemplified embodiment each of the core and sheath components 2100, 2200 comprise a tapered portion that collectively form the conical shape of the tip portion 2300 of the multi-component bristle 2000. Furthermore, in the exemplified embodiment, the free end 2020 of the multi-component bristle 2000 is tapered to a tip or sharp point. Of course, the invention is not to be so limited in all embodiments and in certain other embodiments only the core component 2100 may be tapered while the sheath component 2200 is not tapered or only the sheath component 2200 may be tapered while the core component 2100 is not tapered. Furthermore, in still other embodiments the multi-component bristle 2000 may be tapered, but still have a slightly rounded free end.

By having at least the second portion 2160 of the core component 2100 protrude from the sheath component 2200, at least a portion of each of the core and sheath components 2100, 2200 is exposed and will contact a user's oral cavity during use of an oral care implement comprising the multi-component bristle 2000. Therefore, the oral care additive 2120 on the core component 2100 will be able to be released into the user's oral cavity due to the second portion 2160 being exposed. Thus, in certain embodiments only the second portion 2160 of the core component 2100 that is exposed and not covered or surrounded by the sheath component 2200 may have an oral care additive thereon while the first portion 2150 of the core component 2100 is devoid or free of the oral care additive.

By having the core component 2100 with the first oral care additive 2120 thereon protrude from the sheath component 2200 so as to be exposed (both visibly and for direct contact with a user's oral cavity during use), a greater volume of the oral care additive 2120 is able to be imparted to the user's oral cavity than would be possible if the core component 2100 did not protrude from the sheath component 2200. Specifically, without protruding from the sheath component 2200, only the very top flat end surface of the core component 2100 would contact a user's oral cavity during use, and only a very small amount of the oral care additive 2120 would be released to the user's oral cavity. By extending the core component 2100 a distance beyond the sheath component 2200, a greater amount of the oral care additive 2120 is able to be imparted onto the user's oral cavity to achieve desired benefits. Furthermore, tapering the ends of the multi-component bristle 2000 enables a larger amount of the core component 2100 to protrude from the sheath component 2200 than would be possible with a rounded end, as seen in FIGS. 10A-10C and discussed directly below.

Figure 10A:
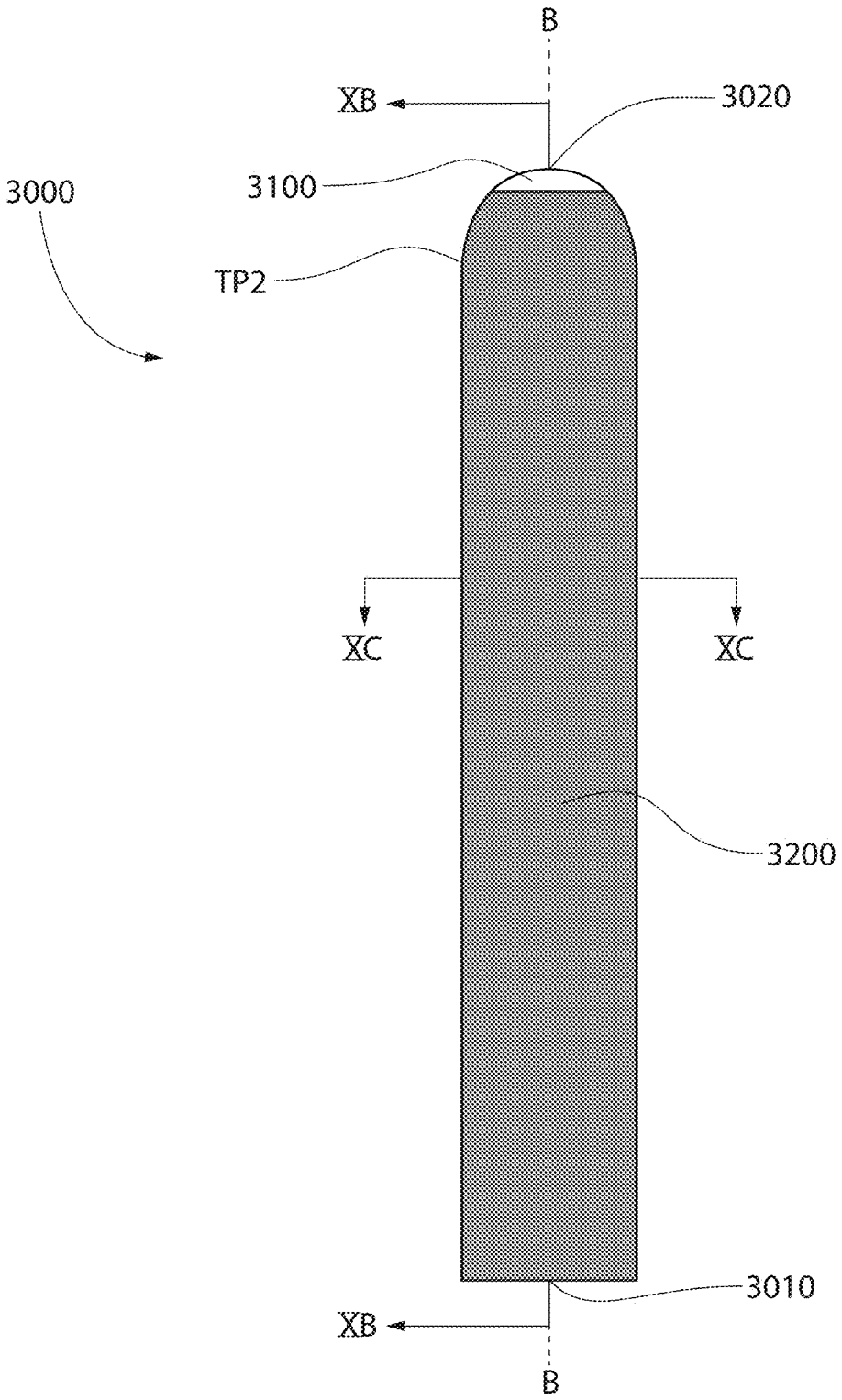
FIG. 10A is a front perspective view of a multi-component bristle in accordance with a sixth embodiment of the present invention.
Figure 10B:
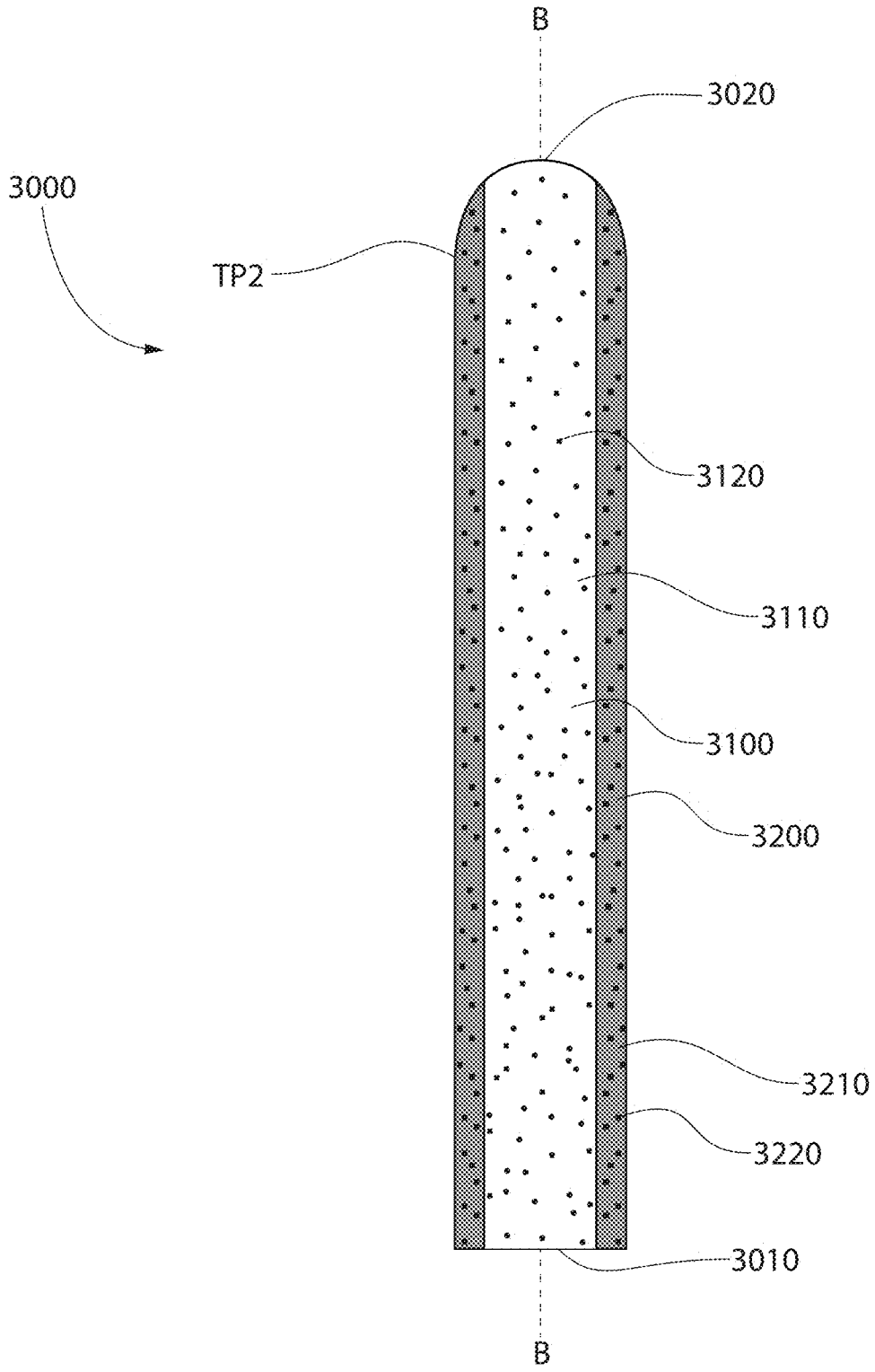
FIG. 10B is a cross-sectional view taken along line XB-XB in FIG. 10A
Figure 10C:
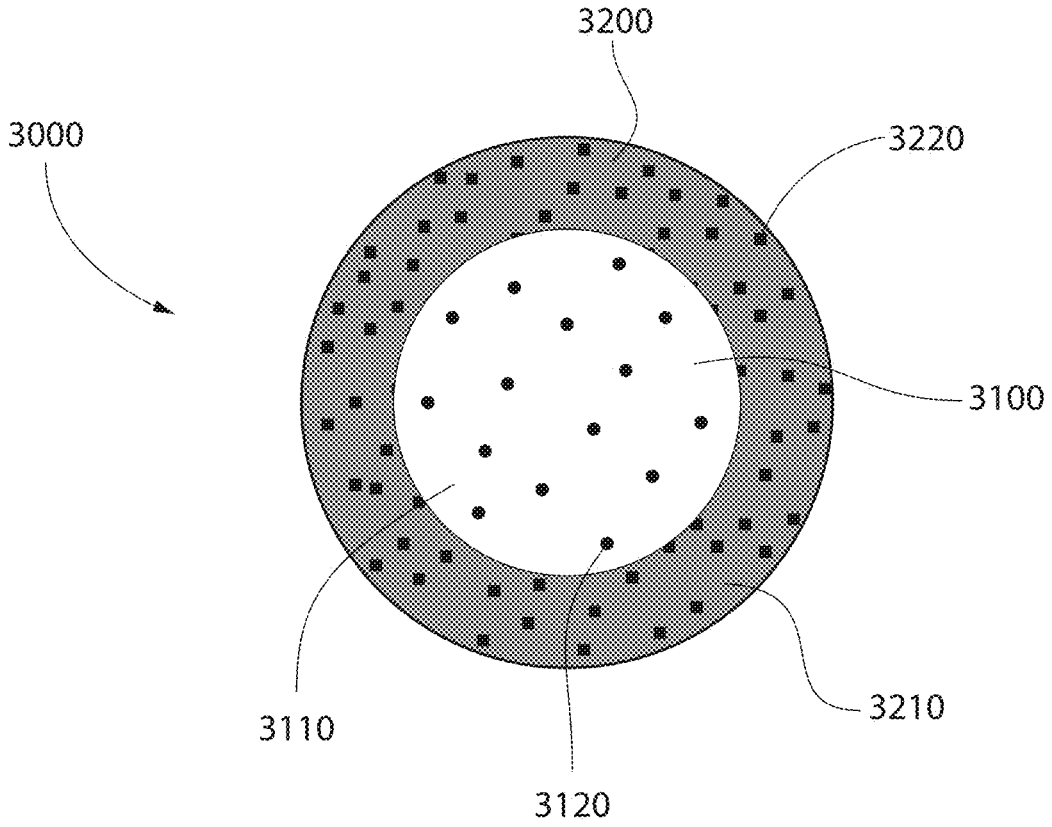
FIG. 10C is a cross-sectional view taken along line XC-XC in FIG. 10A.

Referring now to FIGS. 10A-10C, a multi-component bristle 3000 is illustrated in accordance with another embodiment of the present invention. The multi-component bristle 3000 extends from a base end 3010 to a free end 3020 along a longitudinal axis B-B. The multi-component bristle 3000 comprises a core component 3100 and a sheath component 3200 that are coextruded together to form the multi-component bristle 3000. The multi-component bristle 3000 is similar to the multi-component bristle 2000 except for the shape of the free end 3020 of the multi-component bristle 3000. Specifically, the core component 3100 comprises a first plastic 3110 and a first oral care additive 3120 and the sheath component 3200 comprises a second plastic 3210 and a second oral care additive 3220. The discussion of the first and second plastics 2110, 2210 and the first and second oral care additives 2120, 2220 above with regard to the multi-component bristle 2000 is applicable to the multi-component bristle 3000. Furthermore, the discussion of the different colors and the materials of the first and second plastics discussed above with regard to the multi-component bristle 2000 are applicable to the multi-component bristle 3000.

As noted above, the multi-component bristle 3000 has a different shape at its free end 3020 than the multi-component bristle 2000. Specifically, the free end 3020 of the multi-component bristle 3000 is rounded rather than tapered. In the exemplified embodiment, the multi-component bristle 3000 begins to be rounded at a transition point TP2 such that a portion of each of the core and sheath components 3100, 3200 is rounded. Specifically, the sheath component 3200 is rounded from the transition point TP2 to the terminal end 3030 of the sheath component 3200 and the core component 3100 is rounded from the terminal end 3030 of the sheath component 3200 to the free end 3020 of the multi-component bristle 3000. The core component 3100 has a constant transverse cross-sectional area from the base end 3010 of the multi-component bristle 3000 to the terminal end 3030 of the sheath component 3200 and the sheath component 3200 has a constant transverse cross-sectional area from the base end 3010 of the multi-component bristle 3000 to the transition point TP2.

As a result of the co-extrusion process and the rounding of the free end 3020, only a small portion of the core component 3100 is exposed at the free end 3020 of the multi-component bristle 3000. In the exemplified embodiment, a large majority, such as between 90-99%, or between 92-98%, or between 94-96% of the length of the core component 3100 is covered or surrounded by the sheath component 3200. Of course, the invention is not to be so limited in all embodiments and more or less of the core component 3100 can be exposed in certain other embodiments as desired.

Figure 11A:
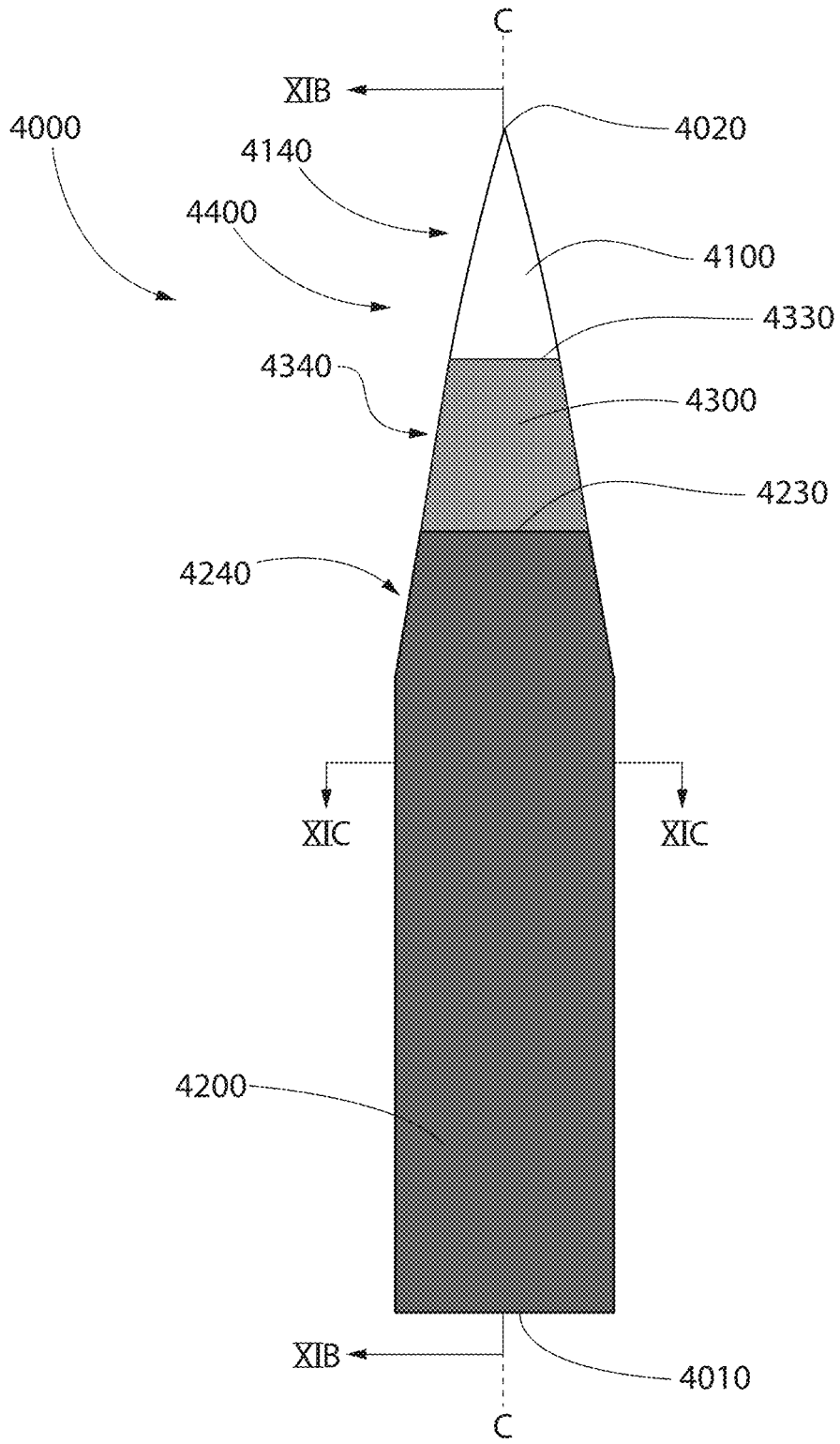
FIG. 11A is a front perspective view of a multi-component bristle in accordance with a seventh embodiment of the present invention.
Figure 11B:
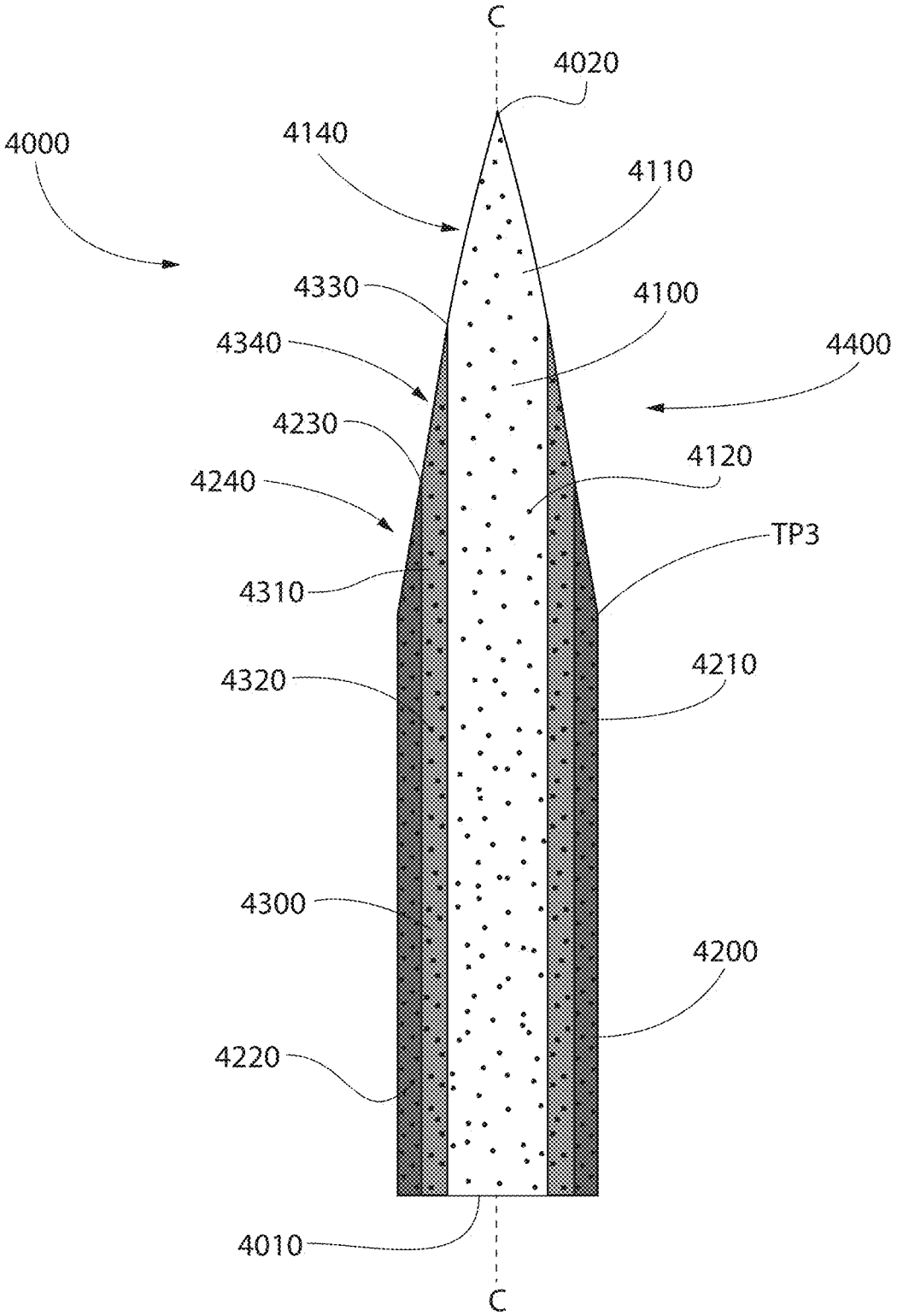
FIG. 11B is a cross-sectional view taken along line XIB-XIB of FIG. 11A.
Figure 11C:
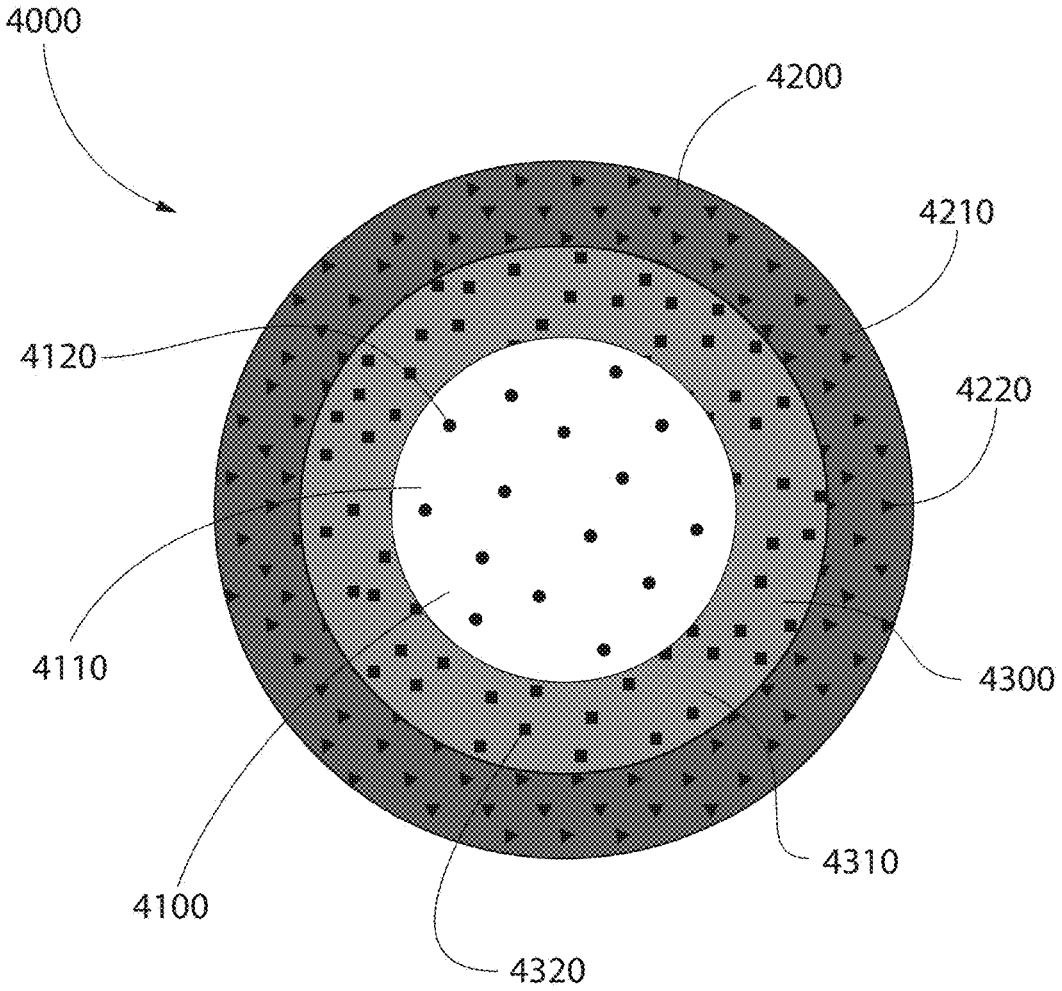
FIG. 11C is a cross-sectional view taken along line XIC-XIC of FIG. 11A.

Referring now to FIGS. 11A-11C, a multi-component bristle 4000 is illustrated in accordance with another embodiment of the present invention. The multi-component bristle 4000 comprises a core component 4100, a sheath component 4200 and an intermediary component 4300. The intermediary component 4300 is positioned between the core component 4100 and the sheath component 4200. Specifically, the sheath component 4200 surrounds a first portion of the intermediary component 4300, a second portion of the intermediary component 4300 protruding from the sheath component 4200. Furthermore, the intermediary component 4300 surrounds a first portion of the core component 4100, a second portion of the core component 4100 protruding through the intermediary component 4300. In certain embodiments, the multi-component bristle 4000 is formed by coextruding the core, sheath and intermediary components 4100, 4200, 4300.

The core component 4100 is formed of a first plastic 4110 and comprises a first oral care additive 4120. The sheath component 4200 is formed of a second plastic 4110 and comprises a second oral care additive 4220. The intermediary component 4300 is formed of a third plastic 4310 and comprises a third oral care additive 4320. Of course, the invention is not to be so limited in all embodiments and in certain other embodiments any one of the core, sheath and/or intermediary components 4100, 4200, 4300 can be free of an oral care additive while the other of the core, sheath and/or intermediary components 4100, 4200, 4300 comprises an oral care additive. In certain embodiments only one of the core, sheath, and intermediary components 4100, 4200, 4300 comprises an oral care additive, in other embodiments two of the core, sheath and intermediary components 4100, 4200, 4300 comprises an oral care additive, and in still other embodiments all three of the core, sheath and intermediary components 4100, 4200, 4300 comprises an oral care additive.

In certain embodiments, each of the first, second and third plastics 4110, 4210, 4310 can be the same, and in other embodiments each of the first, second and third plastics 4110, 4210, 4310 can be different, and in still other embodiments two of the first, second and third plastics 4110, 4210, 4310 can be the same while the other of the first, second and third plastics 4110, 4210, 4310 is different. Furthermore, in certain embodiments each of the first, second and third oral care additives 4120, 4220, 4320 can be a different oral care additive, such as any of the oral care additives discussed above with reference to the multi-component bristle 2000. Any combination of different or the same oral care additives can be used on the various components of the multi-component bristle 4000. All of the disclosure with regard to tapering, rounding, oral care additives, plastic materials, and colors discussed above with regard to the multi-component bristles 2000, 3000 are equally applicable to the multi-component bristle 4000, although one specific embodiment of the multi-component bristle 4000 will be described herein below.

The multi-component bristle 4000 extends from a base end 4010 to a free end 4020 along a longitudinal axis C-C. More specifically, the core component 4100 of the multi-component bristle 4000 extends from the base end 4010 to the free end 4020, the intermediary component 4300 of the multi-component bristle 4000 extends from the base end 4010 to a terminal end 4330 of the intermediary component 4300, and the sheath component 4200 of the multi-component bristle 4000 extends from the base end 4010 to a terminal end 4230 of the sheath component 4200. Furthermore, in the exemplified embodiment the core component 4100 protrudes beyond the terminal end 4330 of the intermediary component 4300, and in the exemplified embodiment the core component 4100 tapers from the terminal end 4330 of the intermediary component 4300 to the free end 4020 of the multi-component bristle 2000. The intermediary component 4300 protrudes beyond the terminal end 4230 of the sheath component 4200, and in the exemplified embodiment the intermediary component 4300 tapers from the terminal end 4230 of the sheath component 4200 to the terminal end 4330 of the intermediary component 4300. The sheath component 4200 tapers from a transition point TP3 to the terminal end 4230 of the sheath component 4200. As used herein, the term taper means that the transverse cross-sectional area of that component decreases from one point to another.

The taper of the multi-component bristle 4000 is continuous in its decrease in cross-sectional area from the transition point TP3 to the free end 4020 of the multi-component bristle 4000. Specifically, the sheath component 4100 tapers from the transition point TP3 to the terminal end 4230 of the sheath component 4100. The sheath component 4100 has a first transverse cross-sectional area at the terminal end 4230. The intermediary component 4300 tapers from the terminal end 4230 of the sheath component 4200 to the terminal end 4330 of the intermediary component 4300. The intermediary component 4300 has the first transverse cross-sectional area at the terminal end 4230 and a second transverse cross-sectional area at the terminal end 4330. Thus, when the intermediary component 4300 begins to taper it has the same transverse cross-sectional area as when the sheath component 4300 ends, thereby creating a continuous, smooth taper between the sheath and intermediary components 4200, 4300. Similarly, the core component 4100 tapers from the terminal end 4330 of the intermediary component 4300 to the free end 4020. The core component 4100 has the second transverse cross-sectional area at the terminal end 4330 that is the same as the transverse cross-sectional area of the intermediary component 4300 at the terminal end 4330. Thus, when the core component 4100 begins to taper it has the same transverse cross-sectional area as when the intermediary component 4300 ends, thereby creating a continuous, smooth taper between the intermediary and core components 4300, 4100.

From the base end 4010 to the terminal end 4230 of the sheath component 4200 only the sheath component 4200 is visible. From the terminal end 4230 of the sheath component 4200 to the terminal end 4330 of the intermediary component 4200 only the intermediary component 4300 is visible. From the terminal end 4330 of the intermediary component 4300 to the free end 4020 of the multi-component bristle 4000 only the core component 4100 is visible. Furthermore, the core component 4100 has a substantially constant transverse cross-sectional area from the base end 4010 to the terminal end 4330 of the intermediary component 4300, the intermediary component 4300 has a substantially constant transverse cross-sectional area from the base end 4010 to the terminal end 4230 of the sheath component 4200, and the sheath component 4200 has a substantially constant transverse cross-sectional area from the base end 4010 to the transition point TP3.

Thus, the core component 4100 has a tapered section 4140, the intermediary component 4300 has a tapered section 4340 and the sheath component 4200 has a tapered section 4240. In the exemplified embodiment, the length of the tapered section 4140 of the core component 4100 is greater than the length of the tapered section 4340 of the intermediary component 4300 and the length of the tapered section 4340 of the intermediary component 4300 is greater than the length of the tapered section 4240 of the sheath component 4200. The ratio of the lengths of the tapered sections 4240, 4340, 4140 is between 1.5:2:3 and 2.5:3:4, and more specifically is approximately 2:2.5:3.5 The tapered sections 4140, 4340, 4240 of the core component 4100, the intermediary component 4300 and the sheath component 4200 collectively form a tapered portion 4400 of the multi-component bristle 4000, the tapered portion 4400 of the multi-component bristle 4000 having a conical shape that decreases in transverse cross-sectional area from the transition point TP3 to the free end 4030 of the multi-component bristle 4000.

As discussed above, in the exemplified embodiment each one of the core, intermediary and sheath components 4100, 4300, 4200 comprises an oral care additive 4120, 4320, 4220. In certain embodiments, any of one or more of the core, intermediary and sheath components 4100, 4300, 4200 may be free of an oral care additive. Furthermore, the oral care additives 4120, 4320, 4220 can be the same or different in different embodiments as desired. In the exemplified embodiment, at least a portion of each of the core component 4100, the intermediary component 4300 and the sheath component 4200 is exposed both visibly from an exterior of the multi-component bristle 4000 and for contact with a user's oral cavity during use of an oral care implement that contains the multi-component bristle 4000. Thus, the benefits of each of the oral care additives 4120, 4320, 4220 can be provided to the user's oral cavity using the multi-component bristle 4000.

Although the multi-component bristle 4000 is described herein as having three different components, the invention is not to be so limited and in other embodiments, four, five or more different components/layers can be used, each of which has a different oral care additive or any combination of the same and different oral care additives and lack thereof. Thus, using the inventive multi-component bristles described herein, an oral care implement can be created that can dispense/release many different oral care additives into a user's oral cavity simultaneously. A combination of different two component (or more) multi-component bristles can be utilized on the same oral care implement head wherein each component has different oral care agents/additives. For example, an oral care implement may include tooth cleaning elements disposed in transverse rows on the head. Each transverse row may include bristle tufts including multi-component bristles in one transverse row include different oral care additives than the multi-component bristles in each other or each adjacent transverse row. A virtually unlimited number of different combinations of the multi-component bristles described herein are possible.

Furthermore, although the invention has been described herein with regard to an oral care implement having at least one bristle tuft having at least one multi-component bristle, in certain embodiments the inventive concept described herein is the multi-component bristle itself. Thus, the invention can simply be a multi-component bristle including coextruded core and sheath components wherein the core component comprises a first plastic and a first oral care additive and the sheath component comprises a second plastic and a second oral care additive, the second oral care additive being different than the first oral care additive.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle;

at least one bristle tuft extending from the head, the at least one bristle tuft comprising at least one multi-component bristle comprising a first component and a second component;

the first component comprising a first plastic and a first oral care additive;

the second component comprising a second plastic and a second oral care additive, wherein the first oral care additive is a different material than the second oral care additive.

2. The oral care implement according to claim 1 wherein each of the first and second plastics is erodible by an etchant.

3. The oral care implement according to claim 2 wherein the first and second plastics are the same.

4. The oral care implement according to claim 1 wherein the tip portion of the at least one multi-component bristle has a conical-shape that decreases in transverse cross-sectional area moving toward a free end of the at least one multi-component bristle.

5. The oral care implement according to claim 4 wherein the conical-shape of the tip portion is formed by chemical etching.

6. The oral care implement according to claim 4 wherein the conical-shape of the tip portion is formed by mechanical grinding.

7. The oral care implement according to claim 1 wherein the first and second plastics are different.

8. The oral care implement according to claim 1 wherein the first plastic is erodible by an etchant and the second plastic is chemically resistant against the etchant.

9. The oral care implement according to claim 8 wherein the first plastic is a polyester and the second plastic is a polyamide.

10. The oral care implement according to claim 1 wherein the first oral care additive is in the form of particles that are mixed into the first plastic; and wherein the second oral care additive is in the form of particles that are mixed into the second plastic.

11. The oral care implement according to claim 1 wherein the at least one multi-component bristle has a rounded free end.

12. The oral care implement according to claim 1 wherein the first oral care additive and the second oral care additive are releasable from the first and second plastics respectively.

13. The oral care implement according to claim 1 wherein the first oral care additive is carried by a first carrier and the second oral care additive is carried by a second carrier, and wherein each of the first and second carriers is water-soluble.

14. The oral care implement according to claim 13 wherein the first carrier has a higher melting temperature than the first plastic and the second carrier has a higher melting temperature than the second plastic.

15. A multi-component bristle comprising:

a first component;

a second component;

the first component comprising a first plastic and a first oral care additive; and the second component comprising a second plastic and a second oral care additive, wherein the first oral care additive is a different material than the second oral care additive.

16. The multi-component bristle according to claim 15 wherein each of the first and second plastics is erodible by an etchant.

17. The multi-component bristle according to claim 15 wherein each of the first and second oral care additives are selected from a group consisting of a mixture of pine tree extract and salt, a tea leaf extract, a pearl powder, a nephrite powder, a charcoal powder, and an antibacterial material.

18. The multi-component bristle according to claim 15 wherein the first oral care additive is carried by a first carrier and the second oral care additive is carried by a second carrier.

19. The multi-component bristle according to claim 18 wherein the first carrier has a higher melting temperature than the first plastic and the second carrier has a higher melting temperature than the second plastic.

20. An oral care implement comprising:

a handle;

a head coupled to the handle;

at least one bristle tuft extending from the head, the at least one bristle tuft comprising at least one multi-component bristle comprising a first component and a second component;

the first component comprising a first oral care additive; and the second component comprising a second oral care additive, wherein the first oral care additive is a different material than the second oral care additive.

* * * * *